US005123811A

United States Patent [19]

Kuroiwa

[11] Patent Number: 5,123,811

[45] Date of Patent: Jun. 23, 1992

[54] SUPERSONIC CENTRIFUGAL COMPRESSOR

[76] Inventor: Kazuo Kuroiwa, 8-18-16 Shirane, Asahi-ku, Yokohama-shi, Kanagawa, Japan

[21] Appl. No.: 442,718

[22] Filed: Nov. 29, 1989

[30] Foreign Application Priority Data

Dec. 5, 1988 [JP] Japan ..... 63-306146

[51] Int. Cl.[5] ..... F01D 1/00; F01D 9/00

[52] U.S. Cl. ..... 415/207; 415/211.2; 415/170.1

[58] Field of Search ..... 415/206, 207, 212.1, 415/170.1, 172.1, 173.1, 173.5, 174.5, 177, 146, 211.2, 148, 126, 150, 156, 10, 178; 417/279

[56] References Cited

U.S. PATENT DOCUMENTS

| | | | |
|---|---|---|---|
| 678,811 | 7/1901 | Oberchain | 415/174.5 |
| 2,323,941 | 7/1943 | Smith | 415/156 |
| 2,596,646 | 5/1952 | Buchi | 415/211.2 |
| 3,232,043 | 2/1966 | Birmann | 60/611 |
| 3,289,921 | 12/1966 | Soo | 415/207 |
| 3,310,940 | 3/1978 | Oetliker | 415/177 |
| 3,574,476 | 4/1971 | Jacomet | 415/36 |
| 3,759,627 | 9/1973 | Ehlinger | 415/178 |
| 3,771,925 | 11/1973 | Friberg et al. | 415/181 |
| 3,873,861 | 3/1975 | Halm | 310/42 |
| 4,232,994 | 11/1980 | Tsuji | 415/127 |
| 4,453,886 | 6/1984 | Wilson | 415/83 |
| 4,502,831 | 3/1985 | Sato et al. | 415/146 |
| 4,927,327 | 5/1990 | Keller | 415/172.1 |

FOREIGN PATENT DOCUMENTS

| | | | |
|---|---|---|---|
| 3148756 | 7/1943 | Fed. Rep. of Germany . | |
| 804394 | 4/1951 | Fed. Rep. of Germany . | |
| 1030695 | 9/1956 | Fed. Rep. of Germany . | |
| 2510319 | 9/1975 | Fed. Rep. of Germany . | |
| 381336 | 11/1906 | France . | |
| 1454330 | 9/1966 | France . | |
| 2109778 | 5/1972 | France . | |
| 2199340 | 9/1973 | France . | |
| 60135695 | 12/1983 | Japan . | |
| 211998 | 10/1940 | Switzerland . | |
| 227404 | 9/1943 | Switzerland . | |
| 891981 | 3/1962 | United Kingdom . | |
| 2196700 | 5/1988 | United Kingdom | 415/207 |

OTHER PUBLICATIONS

Patent Abstracts of Japan, vol. 9, No. 297 (M-432) (2020) 25 Nov. 1985.

Patent Abstracts of Japan, vol. 7, No. 193 (M-238) (1338) 24 Aug. 1983.

*Primary Examiner*—Edward K. Look
*Assistant Examiner*—Hoang Nguyen
*Attorney, Agent, or Firm*—Cumpston & Shaw

[57] ABSTRACT

A supersonic centrifugal compressor comprising an impeller (2), a plurality of vanes (13) radially extending in the impeller to form a plurality of radially extending flow channels therebetween, and a diffuser (3) circumferentially surrounding the impeller and having a circumferential flow channel communicating with the flow channels of the impeller. In the impeller (2), at least one nozzle (18) is provided at the outlet of the flow channel and a contraction (20) is provided at the inlet of the flow channel, so that the flow channel is a low speed flow channel (21). Thus the speed of the fluid is low in the low speed flow channel (21) and high at the outlet of the nozzle (18). Also, in the diffuser (3), backflow preventing and friction reducing projections (33) are provided concentrically in the inner surface of the casing (11). Also, leakage preventing and pressure reducing vanes (37) are provided between the side disk (14, 15) of the impeller (2) and the casing (11), rotatably with the rotatable drive shaft (6). Also, the diffuser (3) comprises a concentric annular contraction (41) and an annular divergent channel (42) on the downstream side thereof. A cross-sectional area of the flow channel at the outlet of the annular divergent channel (42) is greater than that of the flow channel at the largest cross-sectional region (44) on the upstream side of the annular contraction (41), to allow control of the shock wave.

20 Claims, 14 Drawing Sheets

SUPERSONIC CENTRIFUGAL COMPRESSOR

BACKGROUND OF THE INVENTION

1. Field of the Invention

The present invention relates to a radial flow machine, such as a centrifugal compressor and a centripetal turbine operating on a reverse principle thereto. In particular, the present invention relates to a high efficiency centrifugal compressor able to compress a relatively small amount of fluid, and to compress liquidified gas for a supply of hot water, heating and cooling air, and refrigeration.

2. Description of the Related Art

Compressors are classified as reciprocating compressors, rotary compressors, and centrifugal compressors. The volumetric efficiency of the reciprocating compressor and the rotary sleeve type compressor having an eccentric piston is low because of mechanical loss due to piston friction, a wear, power losses caused by an increase in the temperature of a sucked fluid, and residual compressed fluid remaining in the cylinder. Also, lubricating oil is circulated in the compressor together with the fluid to be compressed, and the pressure loss in the circulating lubricating oil is high and further the lubricating oil is mixed with the fluid to be compressed, which causes a deterioration of the properties of the fluid.

A screw type compressor suffers from mechanical loss when driving the rotors synchronously, a pressure loss when circulating a large amount of lubricating oil, a loss of the fluid to be compressed due to leakage, and a rotational friction between the screws and the fluid to be compressed or the lubricating oil. Also, the properties of the lubricating oil are deteriorated. Accordingly, the lubricating oil should be separated from the fluid to be compressed, but this increases the initial costs and running costs.

In a centrifugal compressor, however, the mechanical loss occurs only at the bearings, and thus it is not necessary to circulate the lubricating oil. Nevertheless, the centrifugal compressor has a construction problem in that a loss by leakage of the fluid from the outlets toward the inlets of the impeller, and the rotational friction loss at the disks are high, since a difference between the pressure in the outlets and the pressure in the inlets of the impeller is large, an amount of backflow from the diffuser to the impeller is large, and leakage occur through a clearance between the impeller and the impeller casing. This problem can be dealt with only by constructing a centrifugal compressor having a large capacity, to thereby reduce the loss relative to an enlarged capacity. Conversely, this relative loss will become large when the capacity of the centrifugal compressor is small and, for example, the centrifugal compressor can not function at a capacity of less than 25 refrigeration tons. This is because, if a conventionally arranged centrifugal compressor has a small capacity, the friction in the flow channels in the impeller becomes greater, and a high speed flow of the fluid can not be obtained at the outlets of the impeller due to this increased friction. This further causes an increase in static pressure at the outlets of the impeller, which in turn causes an increase in the backflow from the diffuser. It may also become necessary to reduce the number of vanes of the impeller if the centrifugal compressor has a small capacity, and in this case, there exist portions at the outlets of the impeller at which a static pressure is locally high. Namely, when static pressure at the outlets of the impeller becomes high, leakage loss around the impeller and rotational friction loss become large, and thus the centrifugal compressor no longer operates as required since it does not substantially compress the fluid but still consumes power. Accordingly, a centrifugal compressor with a small capacity has not been produced.

In addition, in a conventionally arranged centrifugal compressor, it is difficult to deal with shock waves and establish a high compression ratio at a single stage, and therefore, a multistage centrifugal compressor must be used when a high compression ratio is required. In this case, it is difficult to completely seal the shaft, and thus the compressed fluid flows back from the higher pressure stage to the lower pressure stage. The leakage loss and loss of power at the shaft seals are large but cannot be avoided.

In addition, the backflow of the fluid from the higher pressure stage to the lower pressure stage is accompanied by a backflow of heat, causing an increase in enthalpy to thereby necessitate a greater head, and thus a further loss of power.

If the above described problems could be solved and a centrifugal compressor having a small capacity produced, this would provide a very effective and ideal centrifugal compressor.

SUMMARY OF THE INVENTION

An object of the present invention is to solve the above-described problems and provide a centrifugal compressor in which a friction of the fluid in the flow channels of the impeller during acceleration is lowered, and a high speed flow with an averaged low static pressure is established at the outlets of the impeller.

A further object of the present invention is to provide a centrifugal compressor in which a difference between the pressure in the outlets and the pressure in the inlets of the impeller is lowered, and the pressure around the impeller is reduced while maintaining a pressure equilibrium at the outer circumferential surface and the inner circumferential surface of the impeller, respectively, to thereby prevent leakage and reduce the rotational friction of the disks.

Another object of the present invention is to provide a centrifugal compressor comprising a diffuser in which a backflow of the fluid is prevented and the high speed fluid is converted to fluid having a high total pressure while maintaining the static pressure in the outlets of the impeller at a low level. The diffuser is made from a heat insulating material, to increase the effectiveness of the compression, and the fluid to be compressed is composed of mixed components.

A still further object of the present invention is to provide a centrifugal compressor in which the injected fluid is under-expanded at the outlets of the impeller and forms a fluid layer with a supersonic velocity, and the resulting shock wave is extinguished at the diffuser, and thus it is possible to develop a supersonic centrifugal compressor in which a high compression ratio can be obtained at a single stage, or a multipurpose centrifugal compressor in which the flow rate can be varied in accordance with a desired head. Accordingly, the objects of the present invention are to realize an efficient centrifugal compressor having a small capacity and to increase the efficiency of a centrifugal compressor having a large capacity.

Fundamentally, heat stems from any particle which is self-vibratory and it is the force that causes other particles to vibrate. Accordingly, any electromagnetic wave which exerts a vibrating force will generate heat. The flow of heat is a transmission of this vibration, so that the higher the number of vibrations the higher the temperature, and the greater the amplitude of vibration, the stronger the heat. Also, the vibrating particle sympathizes at a proper vibration. To increase the temperature by compressing fluid is to increases the number of vibrations from the compressed fluid, and a frictional heat is due to a vibration of molecules by excitation.

A heat insulating material absorbs the vibration of molecules, and heating and cooling are effects caused by a difference in the number and amplitude of a vibration of sensitive cells.

To attain the above objects, according to a first aspect of the present invention, the impeller comprises at least one nozzle at the outlet of each of the flow channels thereof, and a contraction at the inlet of each of the flow channels thereof, so that each of the flow channels between the at least one nozzle and the contraction is a low speed flow channel. By this arrangement, it is possible to reduce a friction of the fluid in the impeller and to obtain a high speed flow of the fluid at the outlets of the impeller, whereby a kinetic energy of the fluid is increased at the outlets of the impeller while a static pressure thereat is lowered, to thus lower a reaction grade. Also, by slowing down the relative velocity of the fluid in the low speed flow channel, it is possible to obtain an averaged speed at the inlets of the nozzles of the impeller.

The contraction at each inlet of the impeller serves to reduce a friction of the fluid at the inlet of the impeller, and to increase the relative velocity of the fluid at the inlet of the impeller, to contribute to an increase of the relative velocity of the fluid at the outlet of the impeller, allowing the construction of an impeller with a small diameter and enabling a reduction of the rotational disk friction. The inflow direction of the fluid at the inlet of the impeller is selected such that the flow of fluid prevents a rotation of the fluid in the low speed flow channel, to thereby average the speed of the fluid in the low speed flow channel at the inlets of the nozzles of the impeller.

The nozzle preferably comprises a supersonic nozzle (convergent-divergent nozzle) to obtain a supersonic flow of the fluid. The supersonic nozzle preferably comprises an under-expansion nozzle to suppress an occurrence of a shock wave, and thus enable a single stage compressor with a large compression ratio to be obtained.

Preferably, a variable adjusting device is provided for variably adjusting an angle of the inflowing direction or the outflowing direction of the fluid in the impeller, or for variably adjusting a cross section of the inlet or the outlet of the impeller in accordance with a required head of the fluid, to level the load and thereby save power, whereby a multipurpose centrifugal compressor can be obtained. For example, the inlet or the outlet of the impeller is provided with an elastic means deformable under a centrifugal force.

Preferably, fluid layer averaging vanes are concentrically and consecutively provided on the peripheries of the side discs of the impeller, to form a circumferentially averaged fluid layer with a uniform pressure and a uniform outflowing direction. The fluid layer averaging vanes preferably comprise expansion vanes with a constant expansion factor in which the fluid continuously expands from the inlet to the outlet of the fluid layer averaging vanes, and preferably such vanes are under-expansion vanes. Also, a variable adjusting device is provided for variably adjusting a cross section of the fluid flowing through the layer averaging vanes. This variable adjusting device preferably comprises an elastic valve deformable under a centrifugal force and thus able to adapt to changes in the amount of the fluid flow.

Preferably, the distance from the axis of the rotatable shaft to the inlet of the impeller is greater than that from the axis of the rotatable shaft to the inner circumferential surface of the side disc, to slow down the absolute speed of the fluid at the inner circumferential surface of the side disc at which the impeller is sealingly surrounded by the impeller casing. Preferably, a circumferential pressure increasing projection is provided concentrically and consecutively on this inner circumferential surface of the side disc, the circumferential pressure increasing projection projecting from the inner circumferential surface into the flow of the fluid, to bring a total pressure to the inner circumferential surface and increase a static pressure thereat, to thereby lower a pressure difference between the inner circumferential surface and the outer circumferential surface of the impeller. The circumferential pressure increasing projection preferably has a spoon-shaped cross-section with a shapened end tip projecting inward of the flow channel, to mitigate a shock of the fluid.

Preferably, a means for adjusting the position of the impeller is provided to obtain a smooth fluid flow toward the diffuser. Also, the impeller casing is preferably surrounded by thermally insulating materials.

Preferably, the fluid to be compressed comprises at least one component selected from the group listed in the appended claims, and the selected component includes all substitutes and isomers thereof. The fluid to be compressed is preferably selected from mixed fluid components, to disperse the energy of a shock wave of the fluid to be compressed and decrease its entropy, to thereby save the power and increase the heat transportation.

According to the second aspect of the present invention, backflow preventing and friction reducing projections are provided concentrically in the inner surface of the impeller casing around the axis of the rotatable shaft. By this arrangement it is possible to prevent a backflow leakage through a space between the impeller and the impeller casing from the outer circumferential surface to the inner circumferential surface of the impeller and reduce the leakage pressure, and thus reduce the rotational disk friction.

More particularly, by providing the backflow preventing and friction reducing projections, the fluid rotates around the impeller therewith and forms a boundary layer around the impeller, which is locally inclined to prevent the backflow, and thus rotational disk friction is reduced.

The end tips of the backflow preventing and friction reducing projections protrude into a portion of the high speed rotating fluid of the thick boundary layer around the impeller, so that the boundary layer is split into a plurality of streams which separately flow between the adjacent backflow preventing and friction reducing projections, in which a portion near to the end tip (near to the impeller) of the backflow preventing and friction reducing projection has a high speed head due to a centrifugal force, directed radially outwardly of the impeller, and another portion near to the root (near to the impeller casing) thereof has a slow speed head; the fluid of this slow speed portion being entrained and accelerated by the fluid of the high speed portion, to thereby average the head therebetween. Therefore, the pressure around the impeller is reduced, and simultaneously, the backflow leakage through a space between the impeller and the impeller casing from the outer circumferential surface to the inner circumferential surface of the impeller is prevented. In this way, backflow is prevented and only the flow of fluid radially outwardly of the impeller remains effective, so that the density of the fluid spirally rotating between the projections becomes smaller as it becomes nearer to the rotating shaft, and thus rotational disk friction is reduced.

Preferably, each of the backflow preventing and friction reducing projections has a spoon-shaped cross section and a wall between the backflow preventing and friction reducing projections has a rounded shape, by which a friction of the spirally rotating fluid is reduced.

Preferably, a clearance adjusting device is provided for making a clearance between the backflow preventing and friction reducing projections and the side disc of the impeller as small as possible, and thus increase the backflow preventing effect and rotational disk friction reducing effect. In this case, the backflow preventing and friction reducing projections are preferably electrically insulated from the impeller casing, to enable a clearance adjusting operation without contact between the projections and the impeller, while applying a voltage between the projections and the impeller.

Preferably, a pressure detecting device is provided in the inner wall of the impeller casing to adequately reduce the pressure around the impeller, and the operation of the compressor can be stopped when an excessive pressure due to surging is detected.

According to the third aspect of the present invention, leakage preventing and pressure reducing projections are provided between the side disc and the impeller casing; the leakage preventing and pressure reducing projections being rotatable with the rotatable shaft. By this arrangement, an excess or insufficient rise of a static pressure due to the rotational disc friction can be compensated to prevent leakage around the impeller and to reduce the rotational disc friction by lowering the pressure around the impeller.

Preferably, each of the leakage preventing and pressure reducing projections has a sharpened edge in a cross section of the fluid flow, to mitigate a shock of the flowing fluid, and preferably has a spoon-shaped cross section to allow the head of the fluid to be further enlarged.

Preferably, the leakage preventing and pressure reducing projection are cantilevered vanes, to shorten the passage of the backflow fluid and to accelerate the backflow fluid before it is decelerated by friction, and thus reduce the power needed for acceleration.

Preferably, backflow returning projections are provided at the fluid inlets of the leakage preventing and pressure reducing vanes, the backflow returning projections being fixed to the impeller casing concentrically and consecutively about the rotatable shaft, to return the back flow fluid to the fluid inlets of the leakage preventing and pressure reducing vanes.

The leakage preventing and pressure reducing vanes are arranged between the side disc of the impeller and the impeller casing such that the total pressure at the circumferential inner and outer surfaces of the impeller, including a rise in the static pressure due to a rotational disc friction, generally equals the inlet and outlet pressures in the impeller, respectively. The leakage preventing and pressure reducing vanes are arranged at the circumferential inner and outer surfaces of the impeller, i.e., at an inner central opening and an outer opening between the side disc of the impeller and the impeller casing. By this arrangement, the pressure around the impeller is further reduced. The leakage preventing and pressure reducing vanes prevent leakage from the outer opening to the inner central opening and from the inner opening to the outer central opening.

The leakage preventing and pressure reducing vanes maintain a pressure equilibrium within a designed range such that the total pressure of a static pressure caused by a rotational friction of the disc of the impeller and a static pressure caused by rotation of the leakage preventing and pressure reducing vanes at the circumferential inner and outer surfaces of the impeller generally equals the inlet and outlet pressures in the impeller, respectively. More particularly, if the inlet and outlet pressures in the impeller are higher than the above described pressures, respectively, the fluid flows back from the inlet and outlet of the impeller, respectively, to the space around the impeller, then the back-flowing fluid is returned to the respective inlets of the leakage preventing and pressure reducing vanes by the backflow returning projections. Accordingly, if the amount of backflow fluid is increased the head of the backflow fluid is increased, since the backflow fluid is accelerated by the leakage preventing and pressure reducing vanes, and thus the increase of the head of the fluid around the impeller causes a reduction of the backflow fluid from the inlet and outlet of the impeller, to thereby reach a pressure equilibrium. This pressure equilibrium is established when the fluid circulates from and to the outlet and the inlet of the leakage preventing and pressure reducing vanes with a circulating pressure which is far lower than the head of the fluid compressed in the impeller. The cantilevered vanes can shorten this circulation passage. Alternatively, if the inlet and outlet pressures in the impeller are lower than the pressures around the impeller, respectively, the pressures around the impeller are reduced and a pressure equilibrium is attained. In this case, an equilibrium is attained in which the fluid retained between the leakage preventing and pressure reducing vanes rotates with the leakage preventing and pressure reducing vanes. A maximum efficiency is obtained when such an equilibrium is attained at both the inner opening and the outer opening of the impeller, and the compressor is designed such that this is a normal operating condition.

In this way, the function of the leakage preventing and pressure reducing vanes adapt themselves to the varying pressure of the inlet and the outlet of the impeller, from the maximum circulating equilibrium at the inner opening to the maximum circulating equilibrium at the outer opening. But if the pressure difference exceeds a designed value, the space around the impeller functions as a bypass to automatically serve as a surging device.

Each of the backflow returning projections has a spoon-shaped cross section with a sharpened edge, and a wall between the backflow returning projections has a rounded shape, to reduce friction of the fluid and smooth the flow of the fluid.

The backflow returning projections are electrically insulated from the impeller casing and a clearance adjusting means is provided for the backflow returning projections to enable a clearance adjusting operation without contact between the backflow returning projections and the leakage preventing and pressure reducing vanes while applying a voltage therebetween. It is thus possible to make a clearance between the backflow returning projections and the leakage preventing and pressure reducing vanes as small as possible, and thus increase a backflow returning effect.

Preferably, a pressure averaging chamber is provided at the outlet of the leakage preventing and pressure reducing vanes, to level the pressure of the flowing-out fluid.

According to the fourth aspect of the present invention, the diffuser has an annular contraction and an annular divergent channel on the downstream side of the annular contraction, concentrically provided in the circumferential flow channel of the diffuser. A circumferential fluid collecting means is connected at an outer end of the circumferential flow channel of the diffuser, a cross-sectional area of the flow channel at the outlet of the annular divergent channel being greater than that of the flow channel at the largest cross-sectional region on the upstream side of the annular contraction. By this arrangement, the boundary layer of the fluid becomes thin at this annular contraction and thus the backflow therethrough is prevented, while converting the fluid from the impeller to the fluid having a high total pressure and maintaining a low static pressure at the outlet of the impeller.

The annular divergent channel is a flow channel in which the cross-sectional area thereof is gradually opened toward the downstream side thereof.

In the case of a subsonic diffuser, the annular contraction is located at the inlet of the flow channel of the diffuser. In the case of the supersonic diffuser, the annular contraction is located midway in the flow channel of the diffuser.

Preferably, annular backflow returning projections are provided in the side walls forming the flow channel of the diffuser at the inlet thereof, to return the fluid flowing back in the boundary layer. This back flowing fluid is then entrained by the high speed fluid again into the diffuser, to thereby prevent the back flow. In the subsonic diffuser, the annular backflow returning projections are located in the annular contraction.

Preferably, an annular rotation averaging flow channel is provided on the downstream side of the annular divergent channel. By this arrangement, the fluid flowing from the annular divergent channel moves rotatingly in this annular rotation averaging flow channel, averaging the pressure by the rotating fluid itself, with the resulting centrifugal force acting against the variety of the pressure in the circumferential fluid collecting means to thereby reduce the pressure at the outlet of the annular divergent channel and to ensure a constant outflow speed of the fluid and a constant outflow angle at the outlet of the annular divergent channel.

In the case of the supersonic diffuser, a cross-sectional area of the flow channel at the outlet of the annular divergent channel is greater than that of the flow channel at the largest cross-sectional region on the upstream side of the annular contraction, to displace a shock wave to a position on the downstream side of the annular contraction, and thereafter allow the shock wave to approach the annular contraction. By this arrangement, it is possible to convert the fluid from the impeller to the fluid having a high total pressure, while maintaining the speed of the fluid at the inlet of the diffuser at a supersonic level, and thus the static pressure at the outlet of the impeller at a low level. Further, preferably a cross-section of the annular contraction is variable, and in this case, it is possible to convert the fluid from the impeller to the fluid having a higher total pressure, and thus obtain a maximum diffuser efficiency, by further narrowing the annular contraction. In this case, the annular contraction is adjusted to allow the shock wave to approach the annular contraction, to thereby substantially extinguish the shock.

In the flow of the fluid in the supersonic diffuser, since the layer of the supersonic fluid from the impeller flows in the diffuser in an under-expansion fluid state, an expansion wave occurs at the inlet of the diffuser. This expansion wave is reflected at a boundary face of the boundary layer and a compression wave occurs. This compression wave grows to an oblique shock wave, and further, to a normal shock wave, and interferes with the boundary layer to generate a pseudo shock wave. This pseudo shock wave is simply called a shock wave. When this shock wave occurs on the upstream side of the annular contraction, by gradually reducing the pressure of the fluid at the outlet of this compressor, the shock wave is displaced from the largest cross-sectional region on the upstream side of the annular contraction (at which the layer of the supersonic fluid in the under-expansion state fully expands) to a region on the downstream side of the annular contraction where a cross-sectional area of the flow channel equal the largest cross-sectional region on the upstream side of the annular contraction. Here, by gradually increasing the pressure of the fluid at the outlet of this compressor, the shock wave is weakened and continuously approaches the annular contraction. In this condition, the fluid on the upstream side of this weak shock wave flows at a supersonic velocity, and the fluid on the downstream side of this weak shock wave flows at a subsonic velocity. Accordingly, the fluid flow is decelerated from the supersonic velocity to the subsonic velocity, and thus the high speed fluid is converted to the fluid having a high total pressure.

In addition, the cross-sectional area of the annular contraction is narrowed by operating the cross-sectional area varying means, and the pressure of the fluid at the outlet of this compressor is again gradually increased, so that the fluid flow is choked at the annular contraction to a sonic velocity and the weak shock wave is finally extinguished, and thus the high speed fluid is converted to the fluid having highest total pressure, and this compressor begins to operate normally. In the normal operation of the compressor, however, the fluid flow may be actually choked to a sonic velocity at a position slightly downstream of the annular contraction, since the fluid has a viscosity, and thus the cross-sectional area varying means of the annular contraction is adjusted so that the fluid flow is choked to a sonic velocity at a position closest to the annular contraction, whereby the boundary layer is the annular contraction is thinnest and thus a maximum backflow preventing effect and the maximum diffuser effect are obtained.

When the cross-sectional area of the annular contraction is not varied, it is possible to obtain an effect similar to that obtained by operating the cross-sectional area varying means, by varying the flow quantity or the Mach number. For example, by using the impeller of the above described first aspect of the present invention, it is possible to increase the Mach number, decrease the flow quantity and heighten the total pressure on the upstream side of the contraction whereby, without a change of the cross-sectional area of the annular contraction, it is possible to displace the shock wave from a region on the upstream side of the annular contraction to a region on the downstream side of the annular contraction. Thereafter, the Mach number, the flow quantity, and the upstream total pressure are gradually returned to the desired normal values to allow the shock wave to approach the annular contraction.

Preferably, the diffuser includes flow channel inlet forming members, and variable adjusting devices are provided for changing the positions of the flow channel inlet forming members, to coincide the inlet of the diffuser with the flowing-in fluid layer in correspondence with the thickness of the fluid layer.

Preferably, variable adjusting devices are provided for changing a cross-sectional area of the circumferential flow channel of the diffuser on the downstream side of the annular divergent channel, to thereby adjust the cross-sectional area of the annular divergent channel to a proper value to prevent the backflow, and to maintain the static pressure in the outlet of the annular divergent channel at a lower level.

In addition to an adjustment of the cross-sectional area of the inlet of the diffuser, the cross-sectional area of the annular contraction, and the cross-sectional area of the circumferential flow channel of the diffuser on the downstream side of the annular divergent channel, it is possible to adjust the cross-sectional area of the other portions of the diffuser in correspondence with a change of the flow quantity.

The diffuser may comprise an elastic valve constituting a deformable wall portion of the flow channel of the diffuser, to change the cross-sectional area of the flow channel of the diffuser by the action of the elastic valve and the pressure of the fluid in the compressor.

A shock wave detecting means may be provided in the flow channel of the diffuser and it is possible to change the pressure of the outlet of the compressor, the cross-sectional area of the annular contraction, and the flow quantity and the Mach number of the supersonic fluid in response to the position of the shock wave, to bring the shock wave near to the annular contraction and thus substantially extinguish the shock wave. The shock wave detecting means may be constituted by, for example, a device detecting an illuminance of a light passed through a shock wave and a difference between the pressures on the upstream and the downstream sides of a shock wave.

A pressure detecting means may be provided in the flow channel of the diffuser to appropriately control the operation of the compressor, or to find the shock wave in response to the detected pressure.

A pressure detecting means may be provided for detecting a pressure of flowing-in fluid to the impeller to determine the head of the impeller in response to the detected pressure, or to control the operation of the compressor with the maximum efficiency in response to a difference between the pressures in the impeller and in the diffuser.

Also, a pressure detecting means is provided for detecting a pressure of flowing-out fluid from the circumferential fluid collecting means to determine the revolution of the impeller, or to control the operation of the compressor with the maximum efficiency in response to a difference between the pressures in the diffuser and in the circumferential fluid collecting means or in response to the position of the shock wave.

A revolution detecting means may be provided for detecting a revolution of the impeller to control the Mach number or the variable adjusting members in response to signals from the revolution detecting means. The revolution detecting means may be constituted by, for example, a device receiving an electric signal from a magnetic sensor.

Also, a position detecting means may be provided for detecting a position of a variable portion of the circumferential flow channel of the diffuser, to detect a reference position and a displacement therefrom of the variable portion.

Preferably, the diffuser includes flow channel inlet forming members which are electrically insulated from the impeller. Also, the diffuser includes flow channel forming opposed side walls, which are electrically insulated from each other. By these arrangements, it is possible to assemble these members while adjusting the relative positions between the opposing members, by determining a contract between the opposing members while applying a voltage therebetween to thereby select respective reference positions. It is also possible to determine the positions of the above described members during the operation of the compressor, from a change of an electric capacity.

Preferably, the operation of the compressor is electronically controlled. This electronical control is carried out by a computer having a known hardware system, and software, and included in another electronical control system using the compressor of the present invention. This electronical control is carried out by the steps of, for example, detecting the revolution of the impeller with the use of an electromagnetic induction, driving a drive motor in response to a signal therefrom, controlling the Mach number, and changing the positions of the variable portions with the use of a digital micrometer having a revolution detecting means. The variable portions are returned to the respective reference positions when the compressor, is stopped, and the variable portions are moved to respective particular positions in accordance with the revolution of the impeller.

Preferably, sharply streamlined guide vanes are arranged in the circumferential flow channel of the diffuser, to guide the fluid therealong and to assist the fluid to flow smoothly when the flow rate is small.

In this case, in which the guide vanes are arranged in a portion of the circumferential flow channel of the diffuser where the fluid flows at a supersonic velocity, preferably the guide vanes have inlet ends having swept back angles, to reduce a friction of the fluid and to weaken the shock wave. Since the supersonic fluid layer flows radially from the impeller into the diffuser, the angle of deflection at the guide vanes becomes small and the inclination of the shock wave also becomes small, so that the shock wave is weakened. Also, since the fluid flows out from the impeller in an under-expansion state and flows in the diffuser, accompanying the expansion wave, the shock wave interferes with this expansion wave and is further weakened.

A cross-sectional area of the circumferential fluid collecting means may become gradually larger toward an output thereof, to level the pressure in the circumferential fluid collecting means to thereby affect an influence of the averaged pressure on the fluid of the upstream side. Also, the circumferential fluid collecting means has a plurality of outputs, to level the pressure in the circumferential fluid collecting means.

A check valve may be provided in the circumferential fluid collecting means at an output thereof to prevent a surging caused when the flow rate of the compressor is decreased, and to prevent a backflow of high pressure fluid and a backflow of heat when the compressor is stopped.

A position adjusting device may be provided for adjusting the position of the casing relative to a further main casing, to adequately determine the position of the annular contraction and the position of the inlet of the diffuser during assembly of the compressor.

The diffuser may be made from thermally insulating material, to prevent a backflow of heat and loss of heat and thereby prevent wasteful compression work and save power.

The fluid to be compressed can be selected from the group, listed in the appended claims, as described previously, and the selected component includes all substitutions and isomers thereof; for example, methylamine includes dimethylamine (ethylamine).

The fluid to be compressed can be used without mixing, but preferably a fluid component adapted to be compressed is mixed with a fluid component adapted to save power. The mixed fluid comprises at least two fluid components more active to each other. Fluid component flows under respective partial pressures, and thus it is possible to increase the heat transporting capacity.

The compression in the compressor surrounded by the thermal insulator can be deemed to be an adiabatic compression, and in particular an irreversible adiabatic compression, since friction and a vortex arise. Therefore, the whole entropy of the fluid to be compressed is increased in the course of compression. The mixed fluid according to the present invention serves to protect the fluid component, adapted to be compressed, from pyrolysis, to disperse the shock energy of this fluid component, and to decrease the entropy thereof, to thereby save power.

BRIEF DESCRIPTION OF THE DRAWINGS

The present invention will become more apparent from the following description of the preferred embodiment with reference to the accompanying drawings, in which.

DESCRIPTION OF THE PREFERRED EMBODIMENT

The illustrated embodiment is an example of a single stage supersonic centrifugal compressor, which can generate a temperature difference of 105° C., for example, from the inlet fluid temperature of −20° C. to the outlet fluid temperature of 85° C., at a compression ratio of 27.8. A fluid medium is selected from liquidized gas which does not affect ozone in stratosphere and is not harmful to human beings and other life forms. A compact and high efficiency electric motor is installed in the compressor, which can rotate at 18,000 revolutions per minute (rpm). The impeller of the compressor typically has an outer diameter of 16.5 cm and an inner diameter of 8.25 cm, so that it is possible to attain Mach numbers of 2.6, using a particular fluid medium. This compressor has an efficiency of 96 percent and a capacity of 2 refrigerating tons. This compressor thus has a relatively small capacity and is intended for use in a home air conditioning unit. It is also possible to apply the present invention to an industrial centrifugal compressor having a large capacity, and the efficiency becomes higher as the capacity becomes larger.

Figure 1:
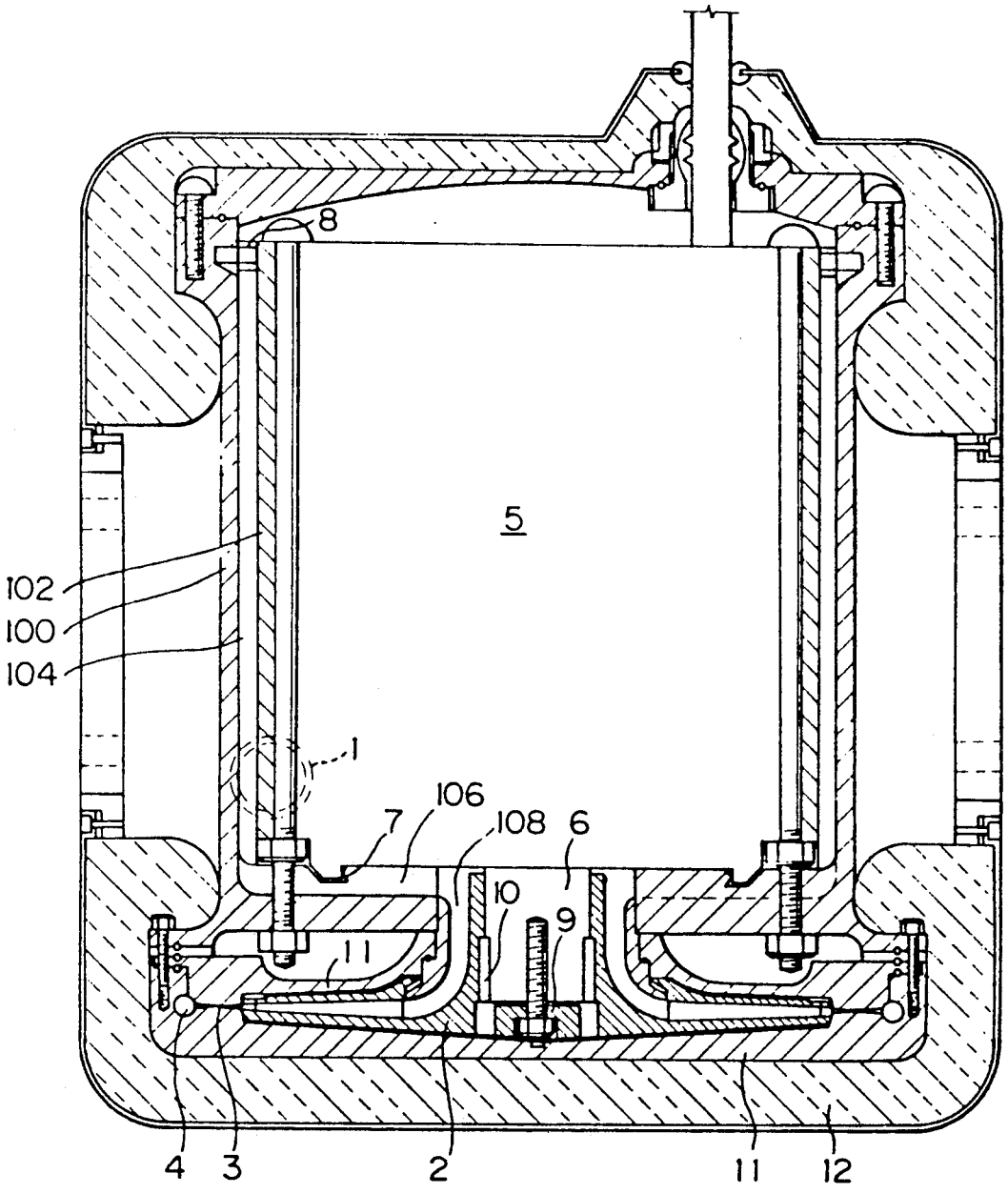
FIG. 1 is an overall sectional view of a centrifugal compressor according to the present invention, on a plane containing the rotatable shaft of the compressor.

Referring now to the drawings, FIG. 1 is an overall sectional view of a centrifugal compressor according to the present invention, show on a plane containing the rotatable shaft of the compressor. The compressor comprises a cylindrical main casing 100 in which a cylindrical motor casing 102 of an electric motor 5 is hermetically installed. An annular clearance 104 exists between the cylindrical main casing 100 and the motor casing 102.

The compressor comprises an impeller 2 fixedly mounted on a rotatable shaft 6, which is common to an output shaft of the motor 5, a diffuser 3 circumferentially surrounding the impeller 2, a circumferential fluid collecting means 4 (often referred to as a spiral casing) further circumferentially surrounding the diffuser 3, and an impeller casing 11 operatively surrounding the former elements and attached to the main casing 100. An intake port 1 is provided in the main casing 100 for introducing the fluid from the outside evaporator of the air conditioning unit (not shown) into the main casing frame 100; the fluid then flowing axially through the annular clearance 104, radially through an end gap 106 between the end faces of the motor casing 102 and the impeller casing 11, and axially through an annular inlet passage 108 between the cylindrical outer surface of the rotatable shaft 6 and the inner peripheral wall of the impeller casing 11, to an inlet 19 of the impeller 2, while rotating in a direction reverse to the direction of rotation of the impeller 2. The fluid is thus sucked into the impeller 2 and accelerated therethrough, the accelerated fluid is converted to the pressurized fluid through the diffuser 3, and the fluid is collected in the circumferential fluid collecting means 4, the fluid in the end gap 106 is partly supplied to and circulated through the motor casing 102 for cooling the motor 5. A position adjusting device 7 is provided between the end faces of the main casing 100 and the motor casing 102 for centering the impeller 2 via the common rotatable shaft 6, and a position adjusting device 8 is provided between the cylindrical surfaces of the main casing 100 and the motor casing 102 for ensuring a perpendicular relationship between the central plane of the diffuser 3 and the rotatable shaft 6, also, a position adjusting device 9 is provided for adjusting the axial position of the impeller 2, and a position adjusting device 10 is provided for ensuring the perpendicular relationship between the rotatable shaft 6 and the impeller 2.

The impeller casing 11, which operatively surrounds the impeller 2, the diffuser 3, and the circumferential fluid collecting means 4, is covered by a heat insulating material 12. The heat insulating material 12 thermally insulates the centrifugal compressor from the outside environment to increase the compression efficiency of the compressor. In this way, preferably the elements constituting the flow channel of the fluid are made from a low thermal conductivity.

Figure 2:
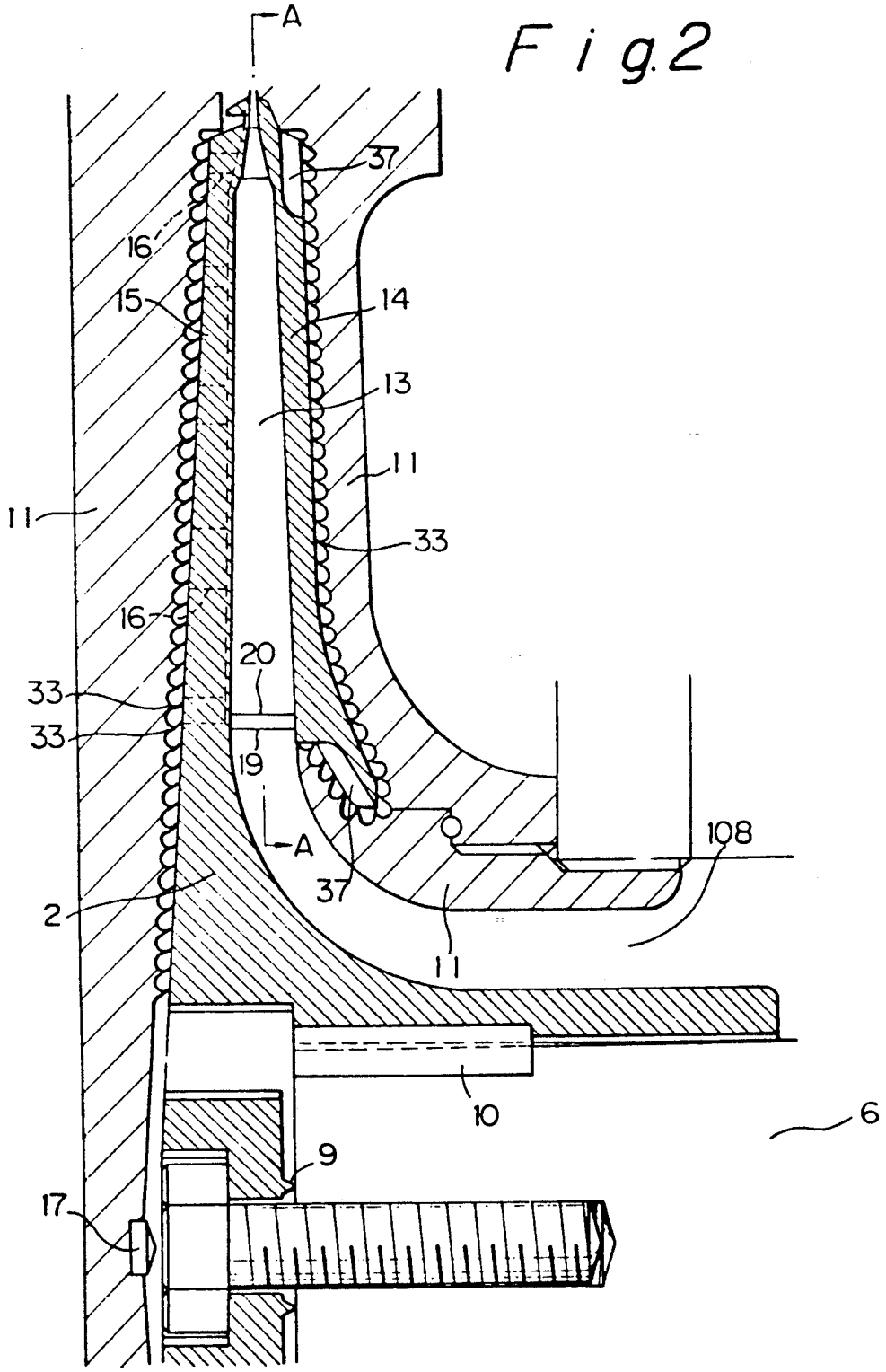
FIG. 2 is an enlarged detailed sectional view of the impeller of the compressor in FIG. 1.

FIG. 2 is a detailed sectional view of the impeller 2, taken along a plane containing the rotatable shaft 6 of the compressor. The impeller 2 comprises a pair of opposed ring-shaped side disks 14 and 15, and radially extending vanes 13 integrally formed with one of the side disks 14 and connected to the other side disk 15 by connecting members 16. The side disk 15 is located on the side remote from the motor 5 and attached to the rotatable shaft 6, while the side disk 14 has an central opening around the rotatable shaft 6 to allow the fluid through the inlet passage 106 to enter the impeller 2. A pressure detecting device 17 is arranged in the center of the outer component of the compressor casing 11, an output signal of which is used to control the operation of the compressor.

Figure 3:
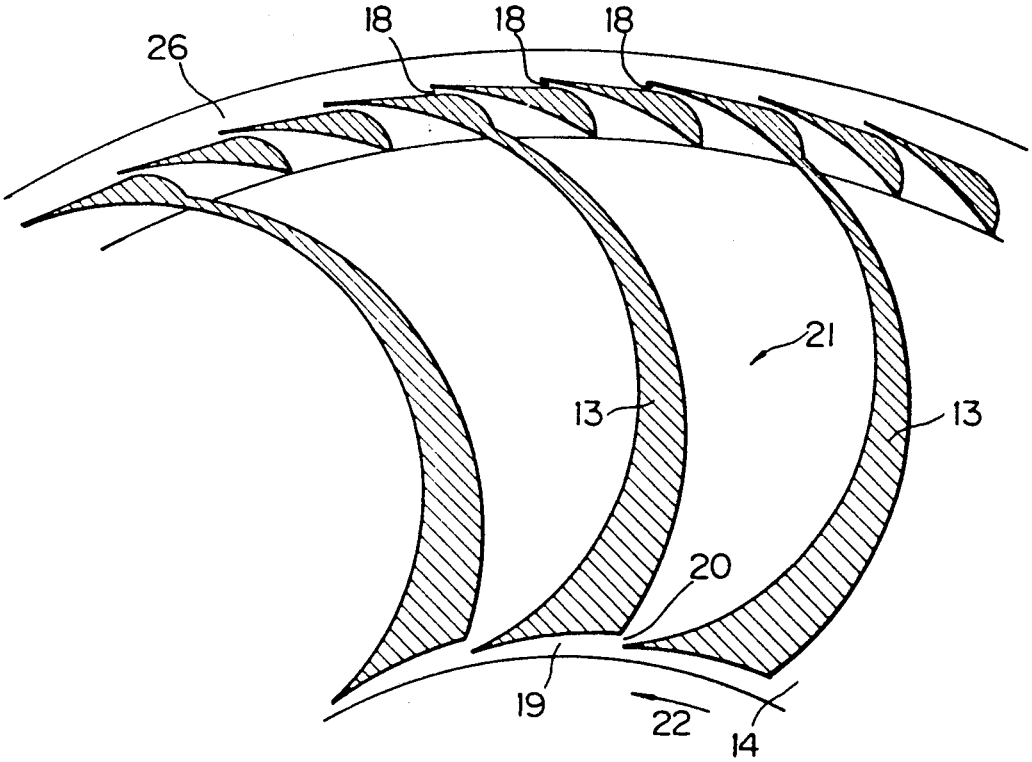
FIG. 3 is a sectional view of the impeller, taken along the line A—A in FIG. 2.
Figure 3:
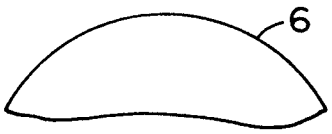

FIG. 3 is a sectional view of the impeller 2, taken along the line A—A in FIG. 2. Flow channels are constituted between two adjacent vanes 13, respectively, and between the side disks 14 and 15, and each flow channel extends generally radially from an inlet 19 on the radially inner side of the impeller 2 to an outlet on the radially inner side of the impeller 2 to an outlet on the radially outer side of the impeller 2. A contraction 20 is provided at the inlet 19 and at least one nozzle 18 is provided at the outlet, and the flow channel is wide spread between the contraction 20 and the at least one nozzle 18 to thereby constitute a slow speed flow channel 21. The arrow 22 shows the rotation direction of the impeller 2. In this embodiment, three nozzles 18 are arranged in a circumferential row for each flow channel between two adjacent, i.e., leading and trailing, vanes 13. Each nozzle 18 is constituted by a supersonic nozzle, i.e., Raval nozzle. In general, the fluid flowing in the flow channel in the impeller 2 is apt to rotate in the direction reverse to the rotating direction 22 of the impeller 2, or to be biased toward the trailing vane 13, so that there is a non-uniform pressure and speed distribution as viewed circumferentially of the impeller 2 even if a total head is uniform, and thus there may be a higher static pressure portion near the trailing vane 13 and a higher speed portion near the leading vane 13. According to the present invention, however, the slow speed flow channel 21 has a large cross-section so that speed of the fluid is slowed therein, and the inlet 19 is shaped such that the fluid entering from the contraction 20 flows in the slow speed flow channel 21 in a direction such that it disturbs the tendency of the fluid to adhere to the trailing vane 13, whereby the static pressure is averaged at all inlets of the nozzles 18 in each flow channel 21.

Figure 4:
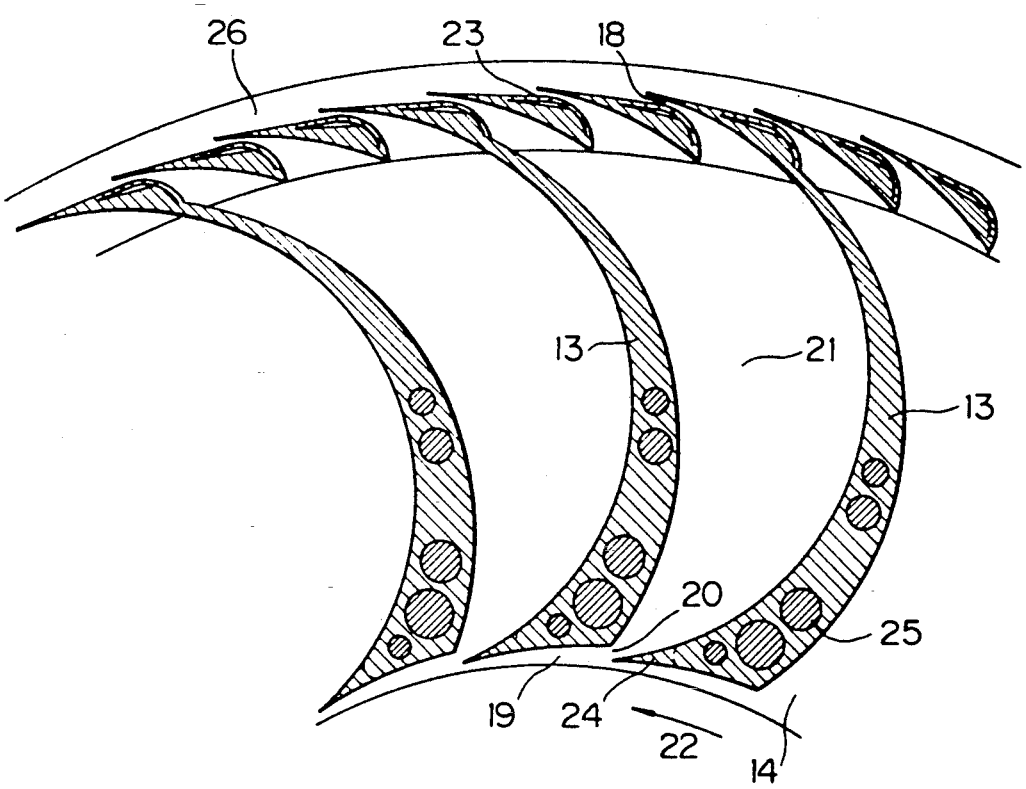
FIGS. 4 and 5 are sectional views similar to FIG. 3 but showing a modified impeller under different operating conditions.
Figure 4:
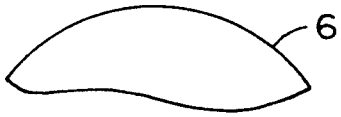
Figure 5:
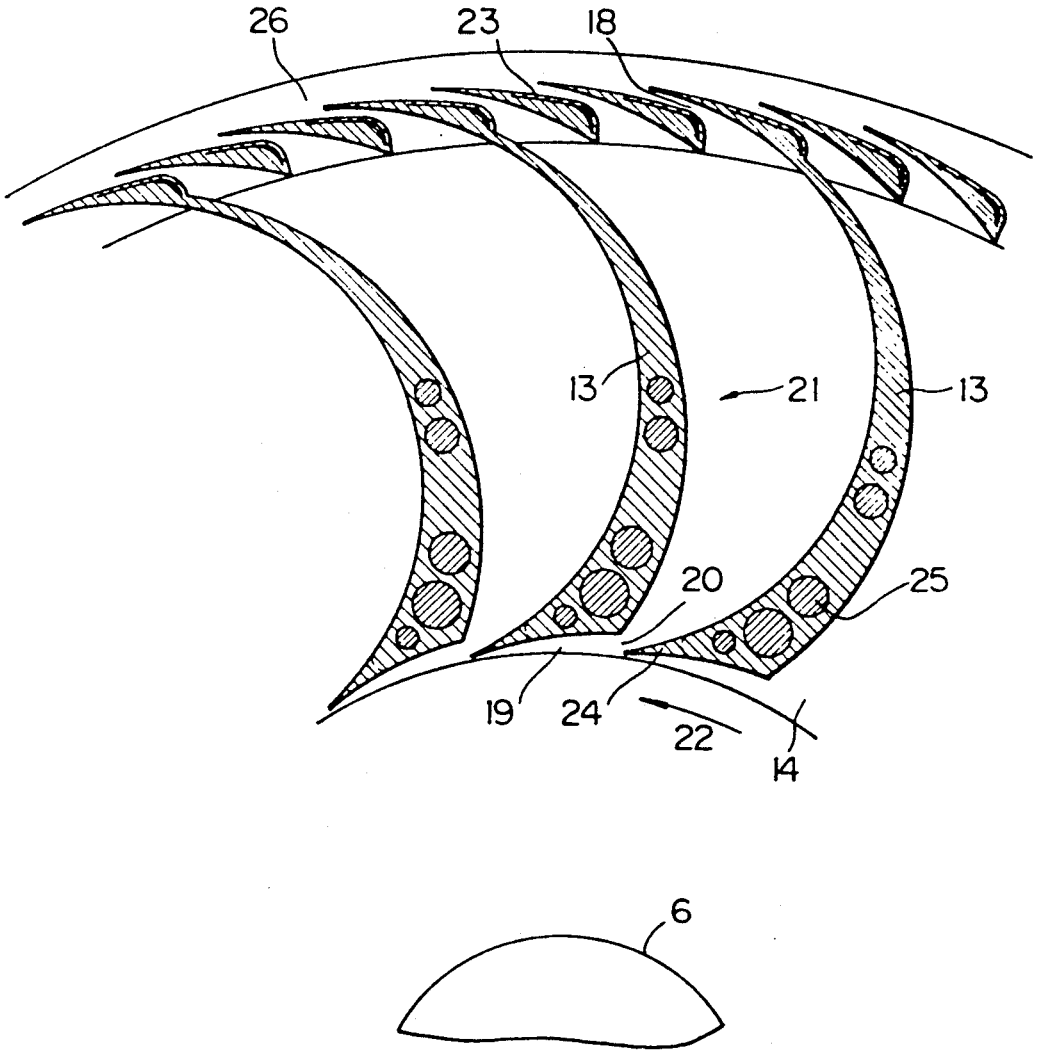

FIGS. 4 and 5 are sectional views similar to FIG. 3, respectively, but showing a modified example in which elastic and centrifugal variable devices 23 and 24 are provided in the contraction 20 and supersonic nozzles 18. In these Figures, the light weight components 25 are made of light weight material form each of the vanes 13, to reduce the weight of the impeller 2. As show in FIG. 5, when the rotation of the impeller 2 becomes low, the centrifugal force applied to the elastic and centrifugal variable devices 23 and 24 is low, so that the angles of the flowing-in direction and of the flowing-out direction are widened to enlarge the cross-sectional areas of the inlet 19 and the outlet of the impeller 2. Therefore, it is possible to increase the flow rate of the fluid during the low rotational operation, compared to the case of FIG. 3 where the elastic and centrifugal variable devices 23 and 24 are not provided. Therefore, even when a necessary head of the compressor is small, the hermetically arranged motor 5 is not brought to a light load condition and thus it is driven at a high efficiency to save power.

Figure 6:
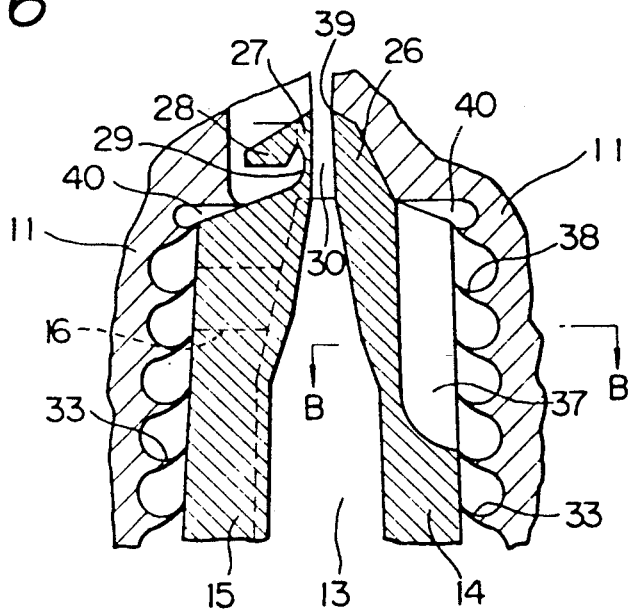
FIG. 6 is an enlarged view of an outlet portion of the impeller of FIG. 2.

FIG. 6 is an enlarged view of the outlet portion of the impeller 2 of FIG. 2. A fluid layer averaging vane 26 is concentrically and consecutively provided on the periphery of the side disk 14 and an associating fluid layer averaging vane 27 is concentrically and consecutively provided on the periphery of the other side disk 15, to form a circumferential flow channel on the downstream side of the supersonic nozzles 18, i.e., on the radially outer side of the supersonic nozzles 18. The fluid layer averaging vanes 26 and 27 form a flow channel 30 therebetween and rotate together with the impeller 2 so that a circumferential fluid layer is maintained therein to average the pressure of the fluid injected from the circumferentially discontinuously arranged supersonic nozzles 18, and to average the flowing-out direction toward the diffuser 3. The fluid layer averaging vanes 26 and 27 are expansion vanes capable of averaging the degree of expansion at each circumferential point. The fluid layer averaging vanes 26 and 27 are under expansion vanes. The fluid layer averaging vane 27 is formed from an elastic material, and constitutes a variably adjusting device for adjusting the cross-section of the flow channel 30. A weight 28 is connected to the fluid layer averaging vane 27, so that when the rotation of the impeller 2 becomes low, the centrifugal force applied to this fluid layer averaging vane 27 becomes low, whereby the elastic force of a spring 29 becomes greater than the centrifugal force to enlarge the cross section of the flow channel 30. This weight 28 is not circularly continuous around the rotation axis of the impeller 2.

Figure 7:
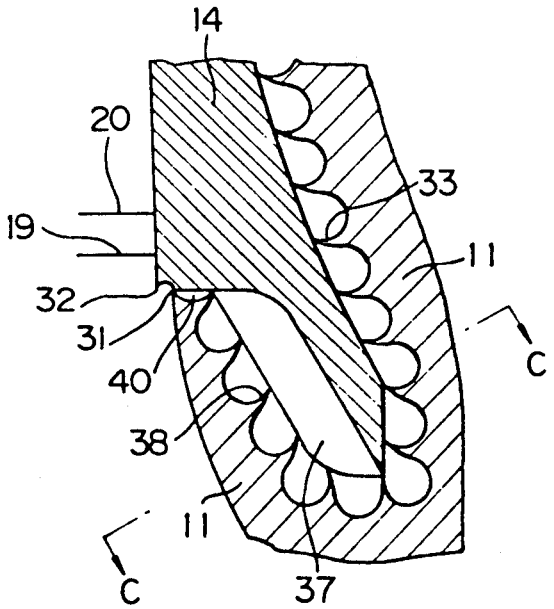
FIG. 7 is an enlarged view of an inlet portion of the impeller of FIG. 2.

FIG. 7 is an enlarged view of the inlet portion of the impeller 2 of FIG. 2. In FIG. 7, the distance from the rotation center of the impeller 2 to the inlet 19 of the impeller 2 is greater than the distance from the rotation center of the impeller 2 is greater than the distance from the rotation center of the impeller 2 to an inner circumferential surface 31 of the central opening of the side disk 14 which an outer correspondingly circumferential surface of an inner ring-shaped portion of the impeller casing 11 sealingly faces. By this arrangement, less fluid in this inner circumferential surface 31 is sucked into the inlet 19 of the impeller 2 under a low static pressure and thus is maintained at a pressure level higher than the static pressure at the inlet 19. Also, a circumferential pressure increasing projection 32 is provided concentrically and consecutively in the inner circumferential surface 31 of the side disk 14 at the inner margin thereof. The circumferential pressure increasing projection 32 has a spoon-shaped cross-section with a sharpened end tip which projects inwardly from the inner margin of the inner circumferential surface 31. Therefore, the fluid flowing toward the inlet 19 of the impeller 2 is dammed at the circumferential pressure increasing projection 32 and a total pressure of a relatively high level prevails at the inner circumferential surface 31, which prevents a back flow leakage of the fluid passing through the interface between the outer surface of the side disk 14 and the facing inner surface of the impeller casing 11.

In FIGS. 6 and 7, backflow preventing and friction reducing projections 33 are provided concentrically in the inner surfaces of the impeller casing 11, facing the outer surface of the side disks 14 and 15. The end tips of the backflow preventing and friction reducing projections 33 are in close proximity to the side disks 14 and 15, so that the fluid in the end tips of the backflow preventing and friction reducing projections 33 rotates with the side disks 14 and 15 at a high speed. A large centrifugal force is applied to the fluid rotating at a high speed, and pressure balances exist at each stage of the backflow preventing and friction reducing projections 33 between the pressure of the fluid based on the centrifugal force and the backflow pressure, with the balanced pressure level being gradually lowered as the stages approach the rotatable shaft 6. Thus, a viscosity of the fluid becomes small and the rotational friction of the disks also becomes small.

Each of the backflow preventing and friction reducing projections 33 has a spoon-shaped cross-section with a sharpened end tip which faces the side disk 14 or 15, so that the fluid in the cavity in the radially outer direction is easily swept away but cannot back flow in the radially inner direction.

The wall between the adjacent backflow preventing and friction reducing projections 33 has a rounded shape, so that the fluid rotates in the cavity in the rounded wall and moves upwardly along the rounded wall, to thereby move in a spiral pattern. This spiral movement of the fluid is smooth and causes less friction.

Figure 10:
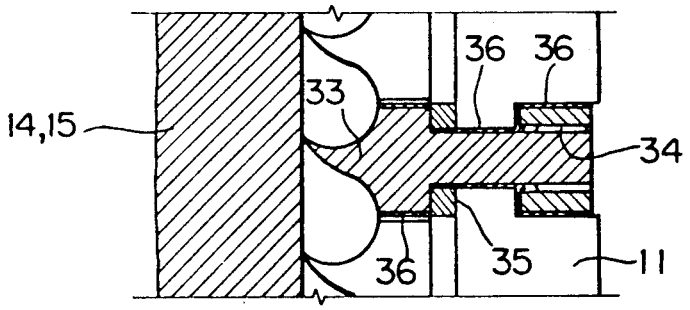
FIG. 10 is an enlarged detailed sectional view of the backflow preventing and friction reducing projection.

FIG. 10 is an enlarged detailed sectional view of the backflow preventing and friction reducing projection 33 in FIG. 7, in which a clearance adjusting device is provided. In FIG. 10, the backflow preventing and friction reducing projection 33 is movably arranged relative to the impeller casing 11 and has a threaded rear portion with which a clearance adjusting screw 34 is engaged. Thus a clearance between the backflow preventing and friction reducing projection 33 and the side disk 14 or 15 can be adjusted by the clearance adjusting screw 34. The backflow preventing and friction reducing projection 33 is attached to the impeller casing 11 via an elastic and electrically insulating member 35, which prevents a leakage of the fluid and electrically insulates the backflow preventing and friction reducing projection 33 from the impeller casing 11. Also, an electrically insulating member 36 is a coating material covered on the backflow preventing and friction reducing projection 33 to electrically insulate same from the impeller casing 11. Therefore, it is possible to carry out an adjustment of a clearance between the backflow preventing and friction reducing projection 33 and the side disk 14 or 15 by applying an electric current therebetween and adjusting the clearance adjusting screw 34.

In FIGS. 6 and 7, leakage preventing and pressure reducing vanes 37 are provided on the outer circumferential surface 39 and the inner circumferential surface 31 of the side disk 14 respectively. The leakage preventing and pressure reducing vanes 37 extend radially to accelerate the backflowing fluid upon rotation thereof to increase a fluid head, so that the pressure around the outer circumferential surface 39 of the side disk 14 equals the outlet pressure from the impeller 2, and the pressure around the inner circumferential surface 31 of the side disk 14 equals the inlet pressure in the impeller 2, respectively, whereby, whereby the leakage around the side disk 14 is prevented and the pressure around the side disk 14 is lowered to decrease a rotational friction of the side disk 14.

Figure 8:
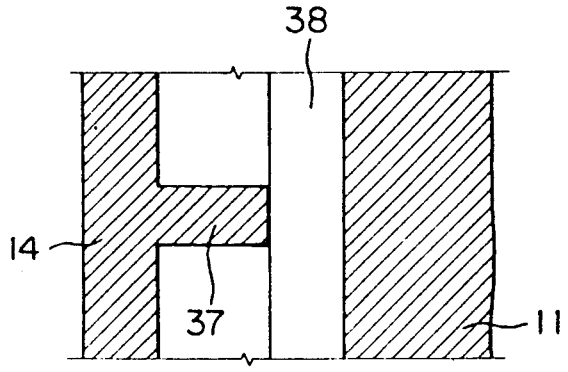
FIG. 8 is an enlarged sectional view of the impeller, taken along the line B—B in FIG. 6.
Figure 9:
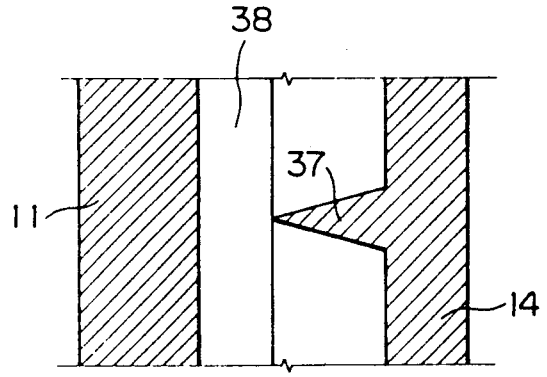
FIG. 9 is an enlarged sectional view of the impeller, taken along the line C—C in FIG. 7.

FIG. 8 is an enlarged sectional view of the impeller 2 taken along the line B—B in FIG. 6, and FIG. 9 is an enlarged sectional view of the impeller 2 taken along the line C—C in FIG. 7. The leakage preventing and pressure reducing vane 37 in FIG. 9 has a sharpened edge in a cross-section of the fluid flow in this embodiment, because this leakage preventing and pressure reducing vane 37 is not perpendicular to the rotatable shaft 6 although the fluid will not circulate through the leakage preventing and pressure reducing vane 37 after an equilibrium condition is established. By this arrangement, it is possible to mitigate an flowing shock of the circulating fluid at a start of the compressor. Conversely, the leakage preventing and pressure reducing vane 37 in FIG. 8 does not have such a sharpened edge in a cross-section of fluid flow because, in this embodiment the fluid will not circulate through the leakage preventing and pressure reducing vane 37 after an equilibrium condition is established. In FIG. 8 and 9, this embodiment is designed to attain a centrifugal equilibrium condition in which the fluid does not circulate through the leakage preventing and pressure reducing vane 37 during a normal operating condition, and thus a spoon-shape in a cross-section of fluid flow is not given in this embodiment. Nevertheless, it is possible to obtain a large head by giving a spoon-shape in a design of a circulating equilibrium condition.

In FIGS. 6, 7, 8, and 9, the leakage preventing and pressure reducing vanes 37 are cantilevered vanes. By this arrangement, it is possible to shorten the circulating path of the circulating fluid and thus save power.

In FIGS. 6 and 7, backflow returning projections 38 are provided at the fluid inlets of the leakage preventing and pressure reducing vanes 37. As in the case of the cantilevered vanes, the entire region is open and becomes fluid inlets, and thus the backflow returning projections 38 are provided entirely over the leakage preventing and pressure reducing vanes 37. The backflow returning projections 38 effectively lead the backflow fluid to the leakage preventing and pressure reducing vanes 37.

In FIGS. 6 and 8, each of the backflow returning projections 38 has a spoon-shaped cross-section with a sharpened end tip, and has a rounded cavity. In this way, the fluid friction is reduced and the flow of the backflow fluid is smoothed.

A clearance adjusting device is provided for the backflow returning projections 38 and an electric insulation is provided between the backflow returning projections 38 and the impeller casing 11. In this embodiment, the backflow returning projections 38 are identical to the backflow preventing and friction reducing projection 33 in FIG. 10.

In FIGS. 6 and 7, pressure averaging chambers 40 exist at the outlets of the leakage preventing and pressure reducing vanes 37, to convert the dynamic pressure of the fluid accelerated by the leakage preventing and pressure reducing vanes 37 to the static pressure and average the non-uniformly distributed pressure to effect a uniform pressure on the outer circumferential surface 39 and the inner circumferential surface 31 of the side disk 14.

Figure 11:
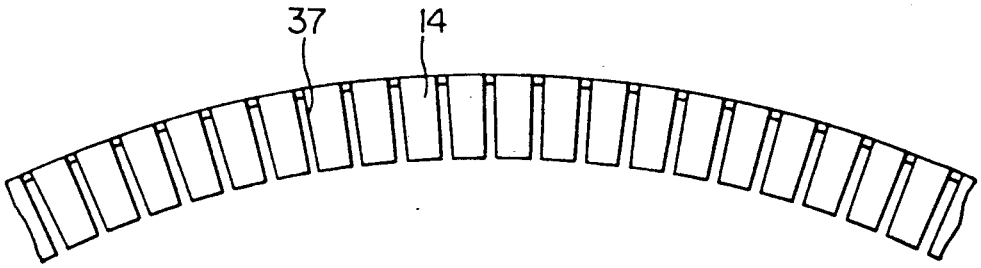
FIG. 11 is a front view of the leakage preventing and pressure reducing vanes of the impeller of FIG. 6.
Figure 12:
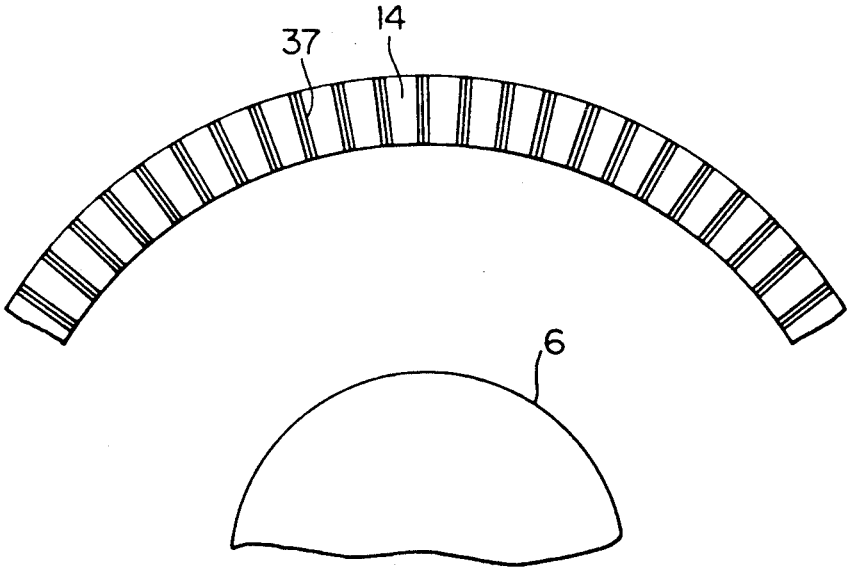
FIG. 12 is a front view of the leakage preventing and pressure reducing vanes of the impeller of FIG. 7.

FIGS. 11 and 12 are front views of the leakage preventing and pressure reducing vanes 37, as viewed in the direction of the rotatable shaft 6 from the open side of the cantilever vanes 37 toward the side disk 14. FIG. 11 is a front view of the leakage preventing and pressure reducing vanes 37 in FIG. 6, and FIG. 12 is a front view of the leakage preventing and pressure 37 in FIG. 7.

Figure 13:
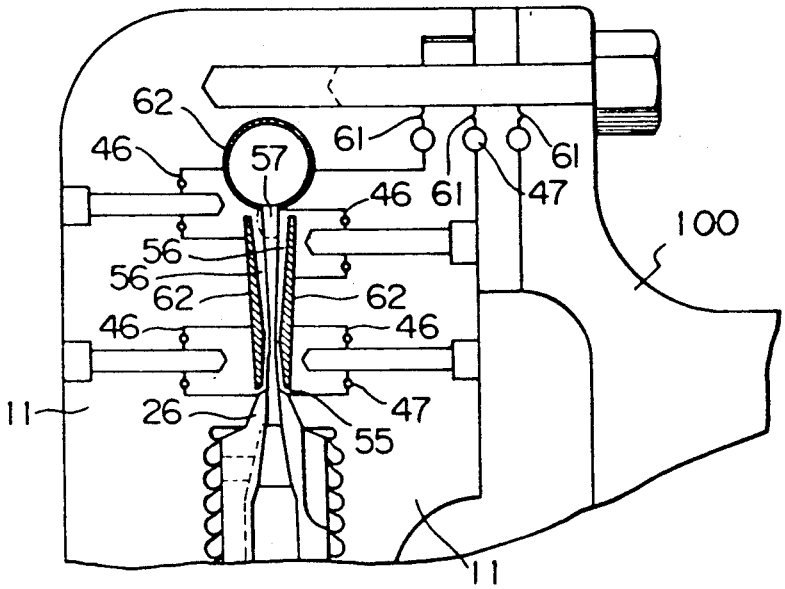
FIG. 13 is an enlarged detailed view of the diffuser of the compressor in FIG. 1.
Figure 14:
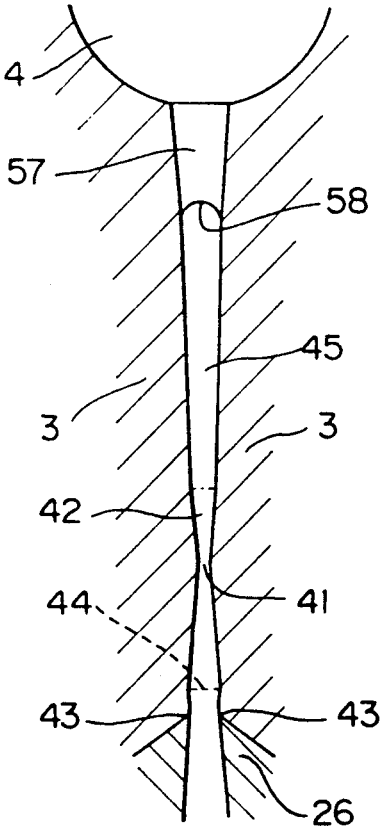
FIG. 14 is an enlarged detailed view of the flow channel of the diffuser of FIG. 13 (and of FIGS. 15 to 17)
Figure 15:
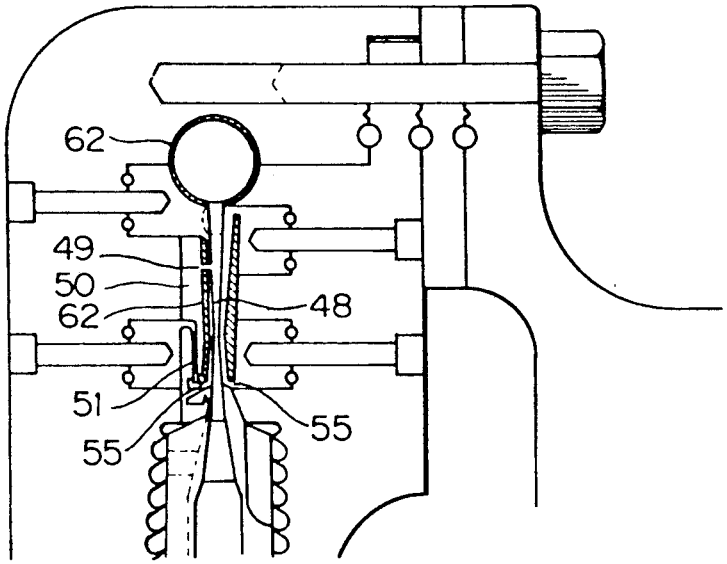
FIG. 15 is a view similar to FIG. 13 but showing the modified diffuser under normal operating conditions.
Figure 16:
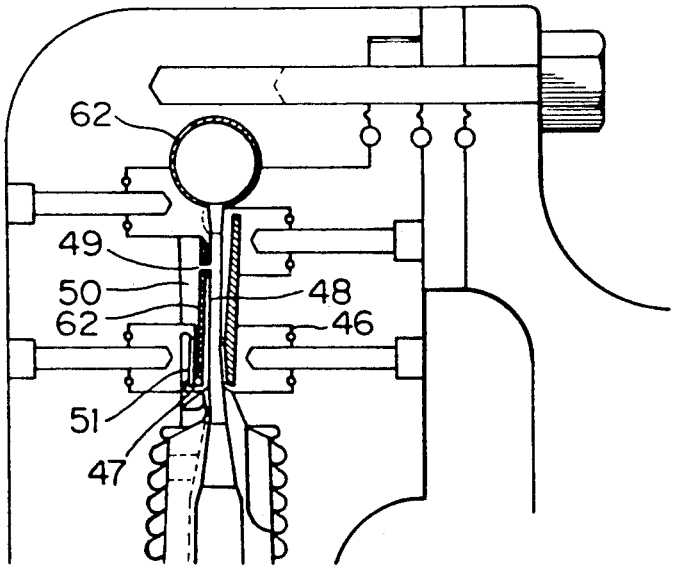
FIG. 16 is a view of the diffuser of FIG. 15 when stopped.
Figure 17:
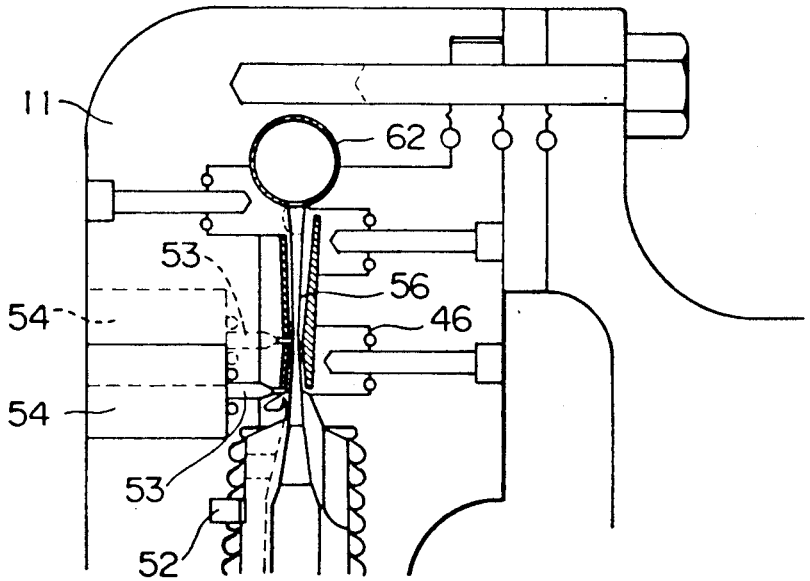
FIG. 17 is a view similar to FIG. 13 but showing a modified electronically controlled diffuser.

FIG. 13 is an enlarged detailed view of the diffuser 3 of the compressor in FIG. 1 and FIG. 14 is an enlarged detailed view of the flow channel of the diffuser 3 of FIG. 13 (and of FIGS. 15 to 17). In FIG. 14, the flow channel of the diffuser 3 is formed as a ring-like annular slit and an annular contraction 41 is provided concentrically in the flow channel of the diffuser 3 and an annular divergent channel 42 follows on the downstream side of the annular contraction 41. In a normal operation of the compressor, a boundary layer of the fluid from the impeller 2 is thinned at the annular contraction 41 and choked here to a sonic velocity. The velocity of the fluid is subsonic at the following annular divergent channel 42 in a normal operation of the compressor, but may become temporarily supersonic in this embodiment of the supersonic centrifugal compressor.

In FIG. 14, annular backflow returning projections 43 are provided in the side walls forming the flow channel of the diffuser 3 at the inlet thereof. The boundary layer is thinned at the annular backflow returning projections 43 and a backflowing fluid in the boundary layer is drawn here by the high speed fluid. The fluid completely expands at a region 44 (shown by the broken line in the drawings) where the cross-section is largest on the upstream side of the annular contraction 41. Since the velocity of the fluid is highest at this largest cross-sectional region 44 it is possible to reduce a static pressure as the distance between the outer circumferential surface 39 and the region 44 is shortened.

In FIG. 14, an annular rotation averaging flow channel 45 is provided on the downstream side of the annular divergent channel 42 (the broken line in the drawings shows a boundary between the annular averaging rotating flow channel 45 and the annular divergent channel 42), and the fluid flows outwardly and rotatingly at a constant flow angle and a constant flow speed.

FIGS. 15 and 16 shows an example which a cross-sectional area of the annular contraction 41 is variable. FIG. 16 is a detailed sectional view of the diffuser 3 of FIG. 15 in which the annular contraction 41 is spread when a shock wave occurs on the upstream side of the annular contraction 41, and FIG. 15 shows the annular contraction 41 in a normal operation of the compressor. In FIG. 16, the cross-sectional area of the flow channel at the outlet of the annular divergent channel 42 is greater than that of the flow channel at the largest cross-sectional region 44 on the upstream side of the annular contraction 41. The shock wave is displaced from the largest cross-sectional region 44 on the upstream side of the annular contraction 41 to a position of the annular divergent channel 42 where the cross-sectional area thereof is equal to that of the largest cross-sectional region 44.

In FIG. 15, when the cross-sectional area of the annular contraction 41 is narrowed after the shock wave was displaced to the annular divergent channel 42, the shock wave approaches the annular contraction 41 and is converted to a higher pressure. When the shock wave is closest the annular contraction 41, the boundary layer is thinnest and the shock wave becomes weakest and is converted to the highest pressure. When the shock wave is at the annular contraction 41, the efficiency of the diffuser 3 becomes 100 percent and the boundary layer at the region of the annular contraction 41 is eliminated. However, the fluid has a viscosity so that the fluid is choked on the downstream side of the annular contraction 41 to the extent due to the viscosity.

Alternatively, when the shock wave is at a position on the upstream side of the annular contraction 41 and the annular contraction 41 is not variable, it is possible to displace the shock wave toward a position on the downstream side of the annular contraction 41, by increasing the speed of the fluid compared to that during a normal operation of the compressor or by decreasing the amount of the flowing fluid compared to that during a normal operation of the compressor. This example is shown in FIG. 13, in which both techniques are used. Namely, the amount of the flowing fluid is decreased compared to that during a normal operation of the compressor, resulting in an excess power which is used to increase the speed of the fluid compared to that during a normal operation of the compressor. It is possible to modify the impeller 2, as previously described, so that the throats of the inlet and nozzles of the flow channel are made variable, whereby the amount of the flowing fluid is decreased and the Mach number is increased. When the Mach number is increased, the extent of expansion should be greater, which leads to an under-expansion at the nozzles even if the cross-sectional area between the fluid layer averaging vanes 26, 27 is not changed. Therefore, the flow of the fluid does not oscillate and it is possible to displace the shock wave.

In FIG. 13, variable adjusting devices 46 are incorporated with the wall members forming the flow channel of the diffuser 3 to adjust the cross-sectional area and position of the flow area. The variable adjusting devices 46 are constructed in a manner similar to the clearance adjusting device in FIG. 10 and have elastic and electrically insulating members in the form of O-rings 47 and electrically insulating coatings. This ensures a formation of a necessary and sufficient flow channel and a smooth flow of the fluid.

FIG. 15 shows an example in which a part of the flow channel including the annular contraction 41 is constituted by an elastic valve 48 and a pressure tank 50 is provided on the opposite side of the elastic valve 48 from the flow channel, with a passage 49 connecting the pressure tank 50 to the flow channel. In this example, the passage 49 for introducing the high pressure fluid into the pressure tank 50 communicates with the annular averaging rotating flow channel 45. Nevertheless is possible to communicate the passage 49 with other positions, such as the spiral casing 4, and to add an exhaust to the pressure tank 50 to electronically control the introduction and exhaust of the fluid in the pressure tank 50 in response to the position of the shock wave.

FIG. 16 shows the compressor when stopped. While the compressor is operated, the annular contraction 41 is spread, as shown in FIG. 16, when a shock wave occurs on the upstream side of the annular contraction 41. In this situation, the pressure in the high pressure tank 50 is relatively low, and thus the flow channel is spread by the spring force of the elastic valve 48 and of a spring 51. When the compressor is started and the high pressure fluid is introduced into the pressure tank 50 via the passage 49, then the pressure in the pressure tank 50 causes the elastic valve 48 to move against the spring force of the elastic valve 48 and of a spring 51 and the cross-sectional area of the flow channel is narrowed in accordance with the pressure of the high pressure fluid, as shown in FIG. 15 in which the compressor is operated at a normal condition. The pressure of the fluid in the flow channel becomes greater as the fluid advances along the flow channel so that, during a normal operation of the compressor, the pressure in the pressure tank 50 can balance the spring force of the elastic valve 48 and of a spring 51, and the flow channel is maintained in a condition as shown in FIG. 15.

However, it is possible that this elastic valve 48 has no passage 49 and pressure tank 50. In this case, the annular contraction is spread by the downstream high pressure of the shock wave before the shock wave is displaced, while it is narrowed by the spring force of the elastic valve 48 and the upstream low pressure of the spring wave after the shock wave is displaced.

FIG. 17 shows a modified diffuser 3 having a variable wall means such as a variable valve which is electronically controlled in addition to the control of the amount of the flowing fluid and the revolutions of the compressor. Piezoelectric elements are arranged along the flow channel of the diffuser 3 to detect the pressure therein, and thereby detect the position of the shock wave in accordance with the change of the pressure. Simultaneously, detecting means are provided for detecting the pressure of the flowing fluid at the inlet of the impeller 2 and at the spiral casing 4, to detect the revolution of the impeller 2 and positions of the variable means. Analogue signals from the piezoelectric elements are converted to digital signals. A magnetic sensor 52 is provided to detect the revolution of the impeller 2, converting a change of magnetic flux to electric signals based on electromagnetic induction, and outputting digital signals. A digital type micrometer 53 is provided to detect the position of the variable portion and outputs digital signals. A closed loop control is carried out in response to these signals to control the flow rate and the revolutions of the impeller 2, and to control the variable portions such as a variable valve by activating an electric motor 54.

In FIGS. 13, 15, 16, and 17, the diffuser 3 includes flow channel inlet forming members 55 and flow channel forming opposed side walls 56. Electrical insulating means comprising elastic O-rings and electrical insulating coatings are provided between flow channel inlet forming members 55 and the impeller 2, and between the opposed side walls 56, so that it is possible to move and locate these elements at desired positions while applying an electric current between the associate members and adjusting the positions therebetween.

Figure 18:
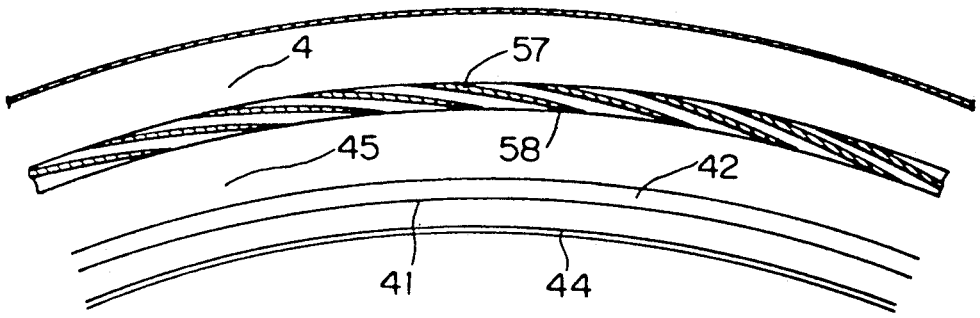
FIG. 18 is a sectional view of the subsonic guide vane.
Figure 18:
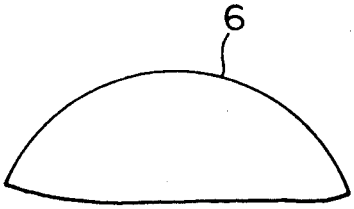

In FIG. 14, guide vanes 57 are provided in the flow channel of the diffuser 3, each of the guide vanes 57 having the shape of a sharp streamline, as viewed in cross-section, in the direction of the fluid flow. The guide vanes 57 guide the fluid flow, so that the fluid flow averaging vane 45 is not affected by the change of the pressure in the spiral casing 4. Each of the guide vanes 57 has an inlet end 58 in the form of a concaved edge with swept back angle, to reduce the flowing shock of the fluid. FIG. 18 shows a cross-section containing the direction of the fluid flow.

Figure 19:
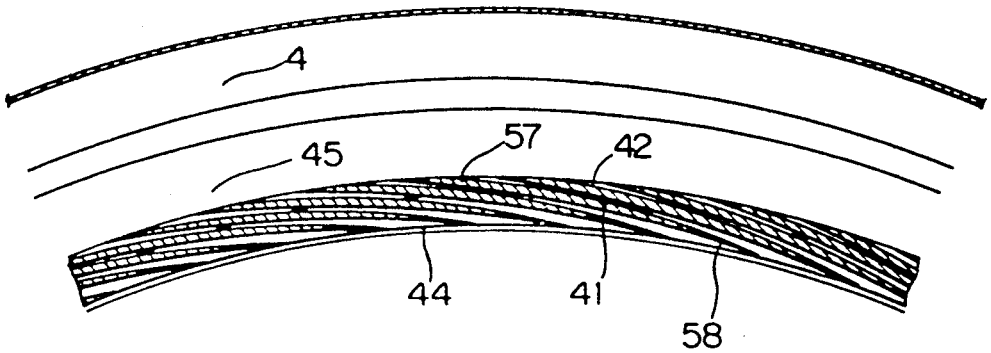
FIG. 19 is a sectional view of the supersonic guide vane.
Figure 19:
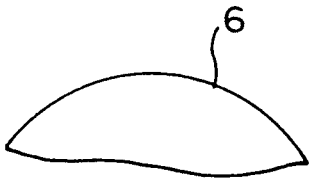

FIG. 19 shows the guide vanes 57 which are located at a region at which a supersonic velocity occurs in which the annular contraction 41 is midway of the guide vanes 57. In this way, since the annular contraction 41 is midway of the guide vanes 57, it is possible to make the cross-section of the annular contraction 41 nearer a rectangular shape, so that an influence of the viscosity of the fluid is reduced and the fluid can flow smoothly therethrough. In this case, the inlet end 58 is in the form of a concaved edge with large sweepback angle.

Figure 20:
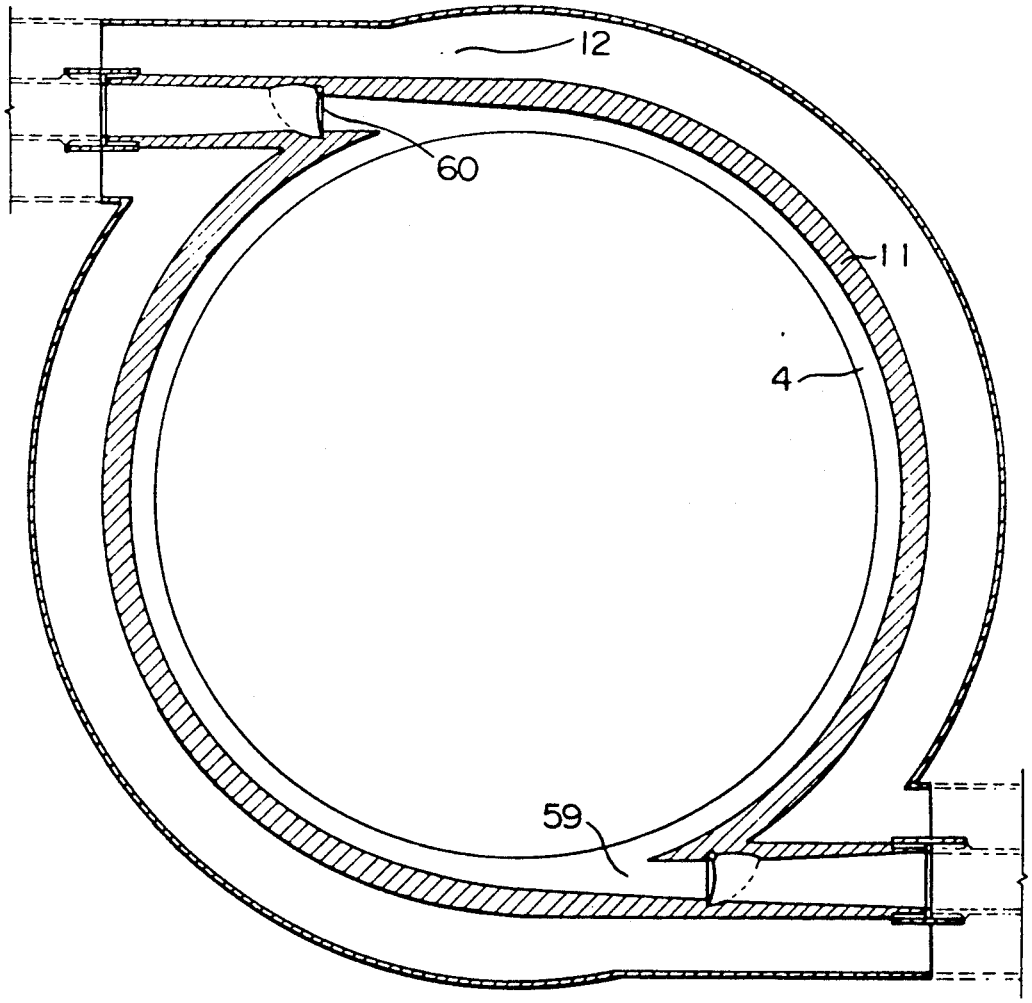
FIG. 20 is a sectional view of the circumferential fluid collecting means, perpendicular to the rotatable shaft.

FIG. 20 is a sectional view of the circumferential fluid collecting means 4, taken perpendicular to the rotatable shaft 6. In FIG. 20, while it is desirable that the cross-sectional area of the circumferential fluid collecting means 4 becomes gradually greater as the point approaches an output 59, in this embodiment, a plurality of outputs 59 are provided and the pressure distribution can be averaged so that the cross-sectional area is constant throughout the circumferential fluid collecting means 4.

In FIG. 20, check valves 60 are provided in the outputs 59, respectively. The check valves 60 are formed by curved surfaces which are continuous with the associated surfaces of the output passages, respectively, when the check valves 60 are opened. By this arrangement, it is possible to mitigate surging and prevent backflow when the operation of the compressor is stopped. As shown in FIG. 13, a position adjusting device 61 is provided for adjusting the position of the impeller casing 11 relative to the main casing 100, mainly to adjust the distance between the rotatable shaft 6 and the flow channels of the diffuser 3.

In FIG. 13, a heat insulating material 62 is provided for preventing a back flow of heat due to heat conduction, to ensure an effective compression. Therefore, the components forming the flow channels have a low thermal conductivity.

While the present invention is described above with reference to the specific embodiment, the present invention is not limited to the illustrated example only and can be modified within the spirit and scope of the present invention.

In summary, the following advantages are obtained according to the present invention.

According to the first aspect of the present invention, the impeller comprises at least one nozzle at the outlet of each of the flow channels thereof, and the contraction at the inlet of each of the flow channels thereof, so that each of the flow channels between the at least one nozzle and the contraction is a low speed flow channel. Therefore, the flowing-out speed of the fluid from the outlet of the impeller is high, resulting in a low static pressure therein and a low reaction grade. Thus it is possible to construct the impeller with a small diameter, enabling a reduction of the rotational disk friction. The fluid layer averaging vanes ensure a uniform flowing-in direction and a uniform flowing-out direction and the circumferential pressure increasing projection maintains a high pressure level at the inner circumferential surface of the impeller. The variable device for adjusting the angles of flowing-in and flowing-out and cross-sectional areas of inlet and outlets allows the construction of a multipurpose centrifugal compressor in which the flow rate is varied in accordance with a necessary head, to save power. The supersonic under-expansion fluid layer suppresses a shock wave occurring at the outlet, and the use of mixed fluids increases the heat transportation and disperses the energy of a shock wave of the fluid to be compressed, to thereby decrease its entropy and save power. Therefore, a supersonic centrifugal compressor having a single stage, a high compression ratio, and a high efficiency can be realized.

According to the second aspect of the present invention, the backflow preventing and friction reducing projections approach the outer surface of the impeller, causing a formation of a thick boundary layer around the impeller, and a head of the spirally rotating fluid between the projections is increased at the end tips thereof to thereby prevent a backflow of the fluid, reduce the leakage pressure, and reduce rotational disk friction.

According to the third aspect of the present invention, the leakage preventing and pressure reducing projections self-adapt to variations in a difference between static pressures of the inlet and the outlet of the impeller to maintain a pressure equilibrium, to prevent leakage, further reduce the leakage pressure, and reduce rotational disk friction. When the difference between static pressures exceeds a designed value, the space around the impeller functions as a bypass to automatically serve as a surge preventing device.

According to the fourth aspect of the present invention, the diffuser has an annular contraction and annular divergent channel on the downstream side thereof. The boundary layer of the fluid becomes thin at the annular contraction, and thus a backflow therethrough is prevented. Therefore, it is possible to convert the high speed fluid with a low static pressure, obtained at the outlet of the impeller, to the fluid having a high total pressure. The backflow returning projections at the inlet of the diffuser and the annular rotation averaging flow channel on the downstream side of the annular divergent channel serve to maintain a lower static pressure of the fluid at the outlet of the impeller. The variable device for adjusting the cross-sectional allows the construction a multipurpose centrifugal compressor in which the flow rate is varied in accordance with a necessary head, and the electronical control sensitively response to changes of the flow rate. The guide vanes with the concaved inlet end decrease fluid friction and prevent backflow, and the heat insulating material increases the compression work. In the conversion of the supersonic flow, the fluid is choked near the annular contraction and the shock wave is substantially extinguished, resulting in a high conversion efficiency. The mixed fluids increase the heat transportation and protect the fluid to be compressed from pyrolysis, decreasing its entropy and bringing the polytropic index to nearly 1, to thereby save power.

According to the present invention, it is possible to realize a supersonic centrifugal compressor having a high efficiency, ranging from a small capacity to a large capacity, which can create a greater temperature difference. Also, it is not necessary to contain lubricating oil in the fluid to be compressed, and therefore, there is no fractional distillation in the lubricating oil whereby components thereof remain at the bottom of the fluid circulating system, causing the fluid passage to be clogged, and it is thus possible to carry out a heat exchange at a low fluid pressure between locations on the ground and underground.

I claim:

1. A centrifugal compressor comprising a casing (11) with an inner surface, an impeller (2) rotatably inserted in said casing about an axis and comprising a pair of side discs (14, 15) with outer surfaces facing the inner surface of said casing and a plurality of vanes (13) radially extending in said side discs to form a plurality of radially extending flow channels between two adjacent vanes, a difuser (3) circumferential flow channel communicating with said flow channels of said impeller, wherein backflow preventing and friction reducing projections (33) are provided concentrically in the inner surface of said casing (11) about said axis, wherein each of said projections (33) has a spoon-shaped cross-section with a sharpened end tip which faces said side disk (14 or 15).

2. A centrifugal compressor according to claim 1, wherein a wall between said backflow preventing and friction reducing projections (33) has a rounded shape.

3. A centrifugal compressor according to claim 1, wherein a clearance adjusting means (34) is provided for adjusting a clearance between at least one of said backflow preventing and friction reducing projections (33) and said side disk (14, 15).

4. A centrifugal compressor according to claim 1, wherein an electrically insulating member (35) is provided in a mechanically interposed member between said backflow preventing and friction reducing projection (33) and a portion of said side disks (14, 15) facing said backflow preventing and friction reducing projection.

5. A centrifugal compressor according to claim 1, wherein a pressure detecting device (17) is provided in said casing (11).

6. A centrifugal compressor comprising a casing (11) with an inner surafce, an impeller (2) rotatably inserted in said casing about an axis and comprising a pair of side discs (14, 15) with outer surfaces facing the inner surface of said casing and a plurality of vanes (13) radially extending in said side discs to form a plurality of radially extending in said side discs to form a plurality of radially extending flow channels between two adjacent vanes, a diffuser (3) circumferentially surrounding said impeller and having a circumferential flow channel communicating with said flow channels of said impeller, and a rotatable shaft (6) for securing said impeller for rotation therewith, wherein leakage preventing and pressure reducing vanes (37) are provided between said side disk (14, 15) and said casing (11), said leakage preventing and pressure reducing vanes (37) being rotatable with said rotatable shaft (6), wherein said vanes (37) are in part provided along the radial length of side disk (14, 15) at the inner circumferential surface (31) of the central opening of the side disk (14) and at the outer circumferential surface 39 of side disk (14).

7. A centrifugal compressor according to claim 6, wherein each of said leakage preventing and pressure reducing vanes (37) have a sharpened edge in a cross-section of fluid flow.

8. A centrifugal compressor according to claim 6, wherein each of said leakage preventing and pressure reducing vanes (37) has a spoon-shaped cross-section in a cross-section along which the fluid flows.

9. A centrifugal compressor according to claim 6, wherein said leakage preventing and pressure reducing vanes (37) are cantilevered vanes.

10. A centrifugal compressor according to claim 6, wherein backflow returning projection (38) are provided at the fluid inlets of said leakage preventing and pressure reducing vanes (37), said backflow returning projections (38) being fixed to said casing concentrically and consecutively about said axis.

11. A centrifugal compressor according to claim 10, wherein each of said backflow returning projections (38) has a spoon-shaped cross-section with a sharpened end tip.

12. A centrifugal compressor according to claim 10, wherein a wall between said backflow returning projections (38) has a rounded shape.

13. A centrifugal compressor according to claim 10, wherein a clearance adjusting means is provided.

14. A centrifugal compressor according to claim 10, wherein an electrically insulating member is provided in a mechanically interposed member between said backflow returning projection (38) and a portion of said side disks (14, 15) facing said backflow returning projection.

15. A centrifugal compressor according to claim 6, wherein a pressure averaging chamber (40) is provided at the outlet of said leakage preventing and pressure reducing vanes (37).

16. A centrifugal compressor comprising a casing (11), an impeller (2) inserted in said casing and rotatable about an axis, a plurality of vanes (13) radially extending in said impeller about said axis to form a plurality of radially extending flow channels between two adjacent vanes, and a diffuser (3) circumferentially surrounding said impeller and having a circumferential flow channel communicating with said flow channels of said impeller, each of said flow channels of said impeller having an inlet on the radially inner side of said impeller and an outlet on the radially outer side of said impeller, wherein at least one nozzle (18) is provided at said outlet of each of said flow channels of said impeller, and a contraction (20) is provided at said inlet of each of said flow channels of said impeller, so that each of said flow channels of said impeller is a low speed flow channel (21), wherein said impeller further includes a pair of side discs (14, 15), one of said side discs (14) having an inner circumferential surface (31) forming a central opening to which an outer correspondingly circumferential surface (39) of an inner ring-shaped portion of said casing (11) is sealingly faced, a shaft (6) extending through said inner ring-shaped portion of said casing with the other side disc (15) secured thereon for rotation therewith, an inlet flow passage (108) being formed between said inner circumferential surface of said inner ring-shaped portion of said casing and the outer surface of said shaft, and wherein the distance from the axis of said shaft (6) to said inlet (19) of said flow channel of said impeller (2) is greater than that from the axis of said shaft (6) to said inner circumferential surface (31) of said one side disc (14).

17. A centrifugal compressor comprising a casing (11), an impeller (2) inserted in said casing and rotatable about an axis, a plurality of vanes (13) radially extending in said impeller about said axis to form a plurality of radially extending flow channels between two adjacent vanes, and a diffuser (3) circumferentially surrounding said impeller and having a circumferential flow channel communicating with said flow channels of said impeller, each of said flow channels of said impeller having an inlet on the radially inner side of said impeller and an outlet on the radially outer side of said impeller, wherein at least one nozzle (18) is provided at said outlet of each of said flow channels of said impeller, and a contraction (20) is provided at said inlet of each of said flow channels of said impeller, so that each of said flow channels of said impeller is a low speed flow channel (21), wherein said impeller includes a pair of side discs (14, 15), one of said side discs (14) having an inner circumferential surface (31) forming a central opening to which an outer correspondingly circumferential surface (39) of an inner ring-shaped portion of said casing (11) is sealingly faced, a shaft (6) extending through said inner ring-shaped portion of said casing with the other side disc (15) secured thereon for rotation therewith, an inlet flow passage (108) being formed between said inner circumferential surface of said inner ring-shaped portion of said casing and the outer surface of said shaft, and wherein a circumferential pressure increasing projection (32) is provided concentrically and consecutively on said inner circumferential surface (31) of said side disc (14).

18. A centrifugal compressor comprising a casing (11), an impeller (2) inserted in said casing and rotatable about an axis, a plurality of vanes (13) radially extending in said impeller about said axis to form a plurality of radially extending flow channels between two adjacent vanes, and a diffuser (3) circumferentially surrounding said impeller and having a circumferential flow channel communicating with said flow channels of said impeller, each of said flow channels of said impeller having an inlet on the radially inner side of said impeller and an outlet on the radially outer side of said impeller, wherein at least one nozzle (18) is provided at said outlet of each of said flow channels of said impeller, and a contraction (20) is provided at said inlet of each of said flow channels of said impeller, so that each of said flow channels of said impeller is a low speed flow channel (21), wherein said impeller includes a pair of side discs (14, 15), one of said side discs (14) having an inner circumferential surface (31) forming a central opening to which an outer correspondingly circumferential surface (39) of an inner ring-shaped portion of said casing (11) is sealingly faced, a shaft (6) extending through said inner ring-shaped portion of said casing with the other side disc (15) secured thereon for rotation therewith, an inlet flow passage (108) being formed between said inner circumferential surface of said inner ring-shaped portion of said casing and the outer surface of said shaft, and wherein a circumferential pressure increasing projection (32) is provided concentrically and consecutively on said inner circumferential surface (31) of said side disc (14), and wherein said circumferential pressure increasing projection (32) has a spoon-shaped cross-section with a sharpened end tip projecting inward of the flow channel.

19. A centrifugal compression comprising a casing (11), an impeller (2) rotatably inserted in said casing about an axis and comprising a plurality of vanes (13) radially extending in said impeller to form a plurality of radially extending flow channels between two adjacent vanes, a diffuser (3) circumferentially surrounding said impeller and having a circumferential flow channel communicating with said flow channels of said impeller, and a rotatable shaft (6) for securing said impeller for rotation therewith, wherein an annular contraction (41), which has a variable cross-section, and an annular divergent channel (42) on the downstream side of said annular contraction are concentrically provided in said circumferential flow channel of said diffuser (3), and a circumferential fluid collecting means (4) is connected at an outer end of said circumferential flow channel of said diffuser (3), a cross-sectional area of the flow channel at the outlet of said annular divergent channel (42) being greater than that of the flow channel at the largest cross-sectional region (44) on he upstream side of said annular contraction (41), and wherein a position detecting means is provided for detecting a position of a variable portion of said circumferential flow channel of said diffusers (3).

20. A centrifugal compressor comprising a casing (11), an impeller (2) rotatably inserted in said casing about an axis and comprising a plurality of vanes (13) radially extending in said impeller to form a plurality of radially extending flow channels between two adjacent vanes, a diffuser (3) circumferentially surrounding said impeller and having a circumferential flow channel communicating with said flow channels of said impeller, and a rotatable shaft (6) for securing said impeller for rotation therewith, wherein an annular contraction (41) and an annular divergent channel (42) on the downstream side of said annular contraction are concentrically provided in said circumferential flow channel of said diffuser (3), and a circumferential fluid collecting means (4) is connected at an outer end of said circumferential flow channel of said diffuser (3), a cross-sectional area of the flow channel at the outlet of said annular divergent channel (42) being greater than that of the flow channel at the largest cross-sectional region (44) on the upstream side of said annular contraction (41), wherein a position adjusting device (61) is provided for adjusting the position of said casing (11) relative to another main casing.

* * * * *